US005173398A

United States Patent [19]

Fukazawa et al.

[11] Patent Number: 5,173,398

[45] Date of Patent: Dec. 22, 1992

[54] SILVER HALIDE COLOR PHOTOGRAPHIC LIGHT-SENSITIVE MATERIAL

[75] Inventors: Fumie Fukazawa; Hiroshi Takada, both of Hino, Japan

[73] Assignee: Konica Corporation, Japan

[21] Appl. No.: 783,893

[22] Filed: Oct. 29, 1991

[30] Foreign Application Priority Data

Oct. 31, 1990 [JP] Japan ..... 2-294415

[51] Int. Cl.[5] ..... G03C 1/005; G03C 7/388

[52] U.S. Cl. ..... 430/546; 430/376; 430/567; 430/569

[58] Field of Search ..... 430/376, 377, 567, 569, 430/546

[56] References Cited

U.S. PATENT DOCUMENTS

| | | | |
|---|---|---|---|
| 4,388,403 | 6/1983 | Helling et al. | 430/377 |
| 4,474,872 | 10/1984 | Onishi et al. | 430/569 |
| 4,668,614 | 5/1987 | Takada et al. | 430/567 |
| 4,879,208 | 11/1989 | Urabe | 430/567 |

FOREIGN PATENT DOCUMENTS 370116 1/1989 European Pat. Off. .

OTHER PUBLICATIONS

Patent Abstracts of Japan, vol. 12, No. 488(P-803)(3335) Dec. 20, 1988; JPA-63-201647; Aug. 19, 1988.

*Primary Examiner*—Charles L. Bowers, Jr.
*Assistant Examiner*—Mark F. Huff
*Attorney, Agent, or Firm*—Jordan B. Bierman

[57] ABSTRACT

There is disclosed a silver halide color photographic light-sensitive material which is improved in image sharpness, pressure resistance and sweating. The photographic material comprises a support and provided thereon a coupler-containing layer, wherein said coupler-containing layer has substantially no high-boiling solvent; and said coupler-containing layer or another layer comprises a silver halide emulsion containing silver halide grains which are formed by supplying silver halide fine grains.

6 Claims, No Drawings

SILVER HALIDE COLOR PHOTOGRAPHIC LIGHT-SENSITIVE MATERIAL

FIELD OF THE INVENTION

The present invention relates to a silver halide photographic light-sensitive material, specifically to a silver halide photographic light-sensitive material which is improved in image sharpness and pressure resistance, and hardly undergoes sweating.

BACKGROUND OF THE INVENTION

Dispersion of a photographic coupler without using high-boiling solvent is already known in the art. By the elimination of a high-boiling solvent in dispersing a coupler, it is possible to obtain a light-sensitive material with a reduced dry thickness. Thin light-sensitive materials are capable of producing a photographic image with improved sharpness. In addition, light-sensitive materials obtained by dispersing a coupler without using a high-boiling solvent are free from sweating. Sweating is a phenomenon that, during storage at high temperatures and/or high humidities, a high-boiling solvent is caused to bleed out from or to be deposited in a light-sensitive material, making the surface of the light-sensitive material wet.

However, light-sensitive materials obtained by dispersing a coupler without using a high-boiling solvent are poorer in pressure resistance than those obtained by using a high-boiling solvent, in which the coupler particles are protected by a high boiling solvent against external pressure.

SUMMARY OF THE INVENTION

The present invention has been made to solve the above problem. In other words, the object of the invention is to provide a silver halide photographic light-sensitive material which is improved in image sharpness and pressure resistance, and hardly undergoes sweating.

The above objects can be attained by a silver halide color photographic light-sensitive material comprising a support and provided thereon at least one coupler-containing layer and at least one silver halide emulsion-containing layer, wherein said coupler-containing layer contains substantially no high-boiling solvent and said silver halide emulsion-containing layer comprises a silver halide emulsion which contains, at least partly, silver halide grains obtained by a fine grain supplying method.

DETAILED EXPLANATION OF THE INVENTION

The present invention will be explained in more detail.

The silver halide photographic light-sensitive material of the invention has a support and provided thereon at least one coupler-containing layer which contains substantially no high-boiling solvent. Here, a coupler means a substance capable of being coupled, at its active site, to a color developer that has been oxidized. Couplers referred to herein include normal dye-forming couplers and those having at their active sites photographically effective substances, such as development inhibitors, anti-foggants, dyes, desilvering accelerators, development accelerators, foggants and fluorescent agents, or precursors thereof.

In the invention, it is preferable to employ a hydrophobic coupler with a low molecular weight, which does not contain a sulfonyl group, a carboxyl group nor a phosphoryl group in each molecule. Here, low molecular weights mean molecular weights not more than 2,000 (preferably not more than 1,500, more preferably not more than 1,000) and hydrophobic means having a solubility to 100 g of distilled water (25° C.) of not more than 0.1 g (preferably not more than 0.01 g, more preferably not more than 0.001 g).

Dye-forming couplers to be employed in the invention include magenta couplers, cyan couplers and yellow couplers. Examples of suitable magenta couplers include 5-pyrazlone-based couplers, pyrazolobenzimidazole-based couplers, pyrazolotriazole-based couplers, open-chain acylacetonitrile-based couplers, which are already known in the art. Specific examples of useful magenta couplers are given in Japanese Patent Application Nos. 164882/1983, 167326/1983, 206321/1983, 214863/1983, 217339/1983, 24653/1984, Japanese Patent Examined Publication Nos. 6031/1965, 6035/1965, 40757/1970, 27411/1972 and 7854/1974, Japanese Patent Publication Open to Public Inspection (hereinafter referred to as Japanese Patent O.P.I. Publication) Nos. 13041/1975, 26541/1976, 37646/1976, 105820/1976, 42121/1977, 123129/1978, 125835/1978, 129035/1978, 48540/1979, 29236/1981, 75648/1981, 17950/1982, 35858/1982, 146251/1982 and 99437/1984, British Patent No. 1,252,418, U.S. Pat. Nos. 2,600,788, 3,005,712, 3,062,653, 3,127,269, 3,214,437, 3,253,924, 3,311,476, 3,419,391, 3,519,429, 3,558,319, 3,582,322, 3,615,506, 3,658,544, 3,705,896, 3,725,067, 3,758,309, 3,823,156, 3,834,908, 3,891,445, 3,907,571, 3,926,631, 3,928,044, 3,935,015, 3,960,571, 4,076,533, 4,133,686, 4,237,217, 4,241,168, 4,264,723, 4,301,235 and 4,310,623.

Conventional naphthol-based couplers and phenol-based couplers are suitable as cyan dye-forming couplers. Preferred examples of cyan dye-forming couplers are given in British Patent Nos. 1,038,331 and 1,543,040, Japanese Patent Examined Publication No. 36894/1973, Japanese Patent O.P.I. Publication Nos. 59838/1973, 137137/1975, 146828/1976, 105226/1978, 115230/1979, 29235/1981, 104333/1981, 126833/1981, 133650/1982, 155538/1982, 204545/1982, 118643/1983, 31953/1984, 31954/1984, 59656/1984, 124341/1984 and 166956/1984, U.S. Pat. Nos. 2,369,929, 2,423,730, 2,434,272, 2,474,293, 2,698,794, 2,772,162, 2,801,171, 2,895,826, 3,253,924, 3,311,476, 3,458,315, 3,476,563, 3,591,383, 3,737,316, 3,758,308, 3,767,411, 3,790,384, 3,880,661, 3,926,634, 4,004,929, 4,009,035, 4,012,258, 4,052,212, 4,124,396, 4,134,766, 4,138,258, 4,146,396, 4,149,886, 4,178,183, 4,205,990, 4,254,212, 4,264,722, 4,288,532, 4,296,199, 4,296,200, 4,299,914, 4,333,999, 4,334,011, 4,386,155, 4,401,752 and 4,427,767.

As yellow dye-forming couplers, conventional acylacetoanilide-based couplers, in particular, benzoylacetoanilide-based compounds and pyvaloylacetoanilide-based compounds, can be advantageously employed. Specific examples of such couplers are given in British Patent No. 1,077,874, Japanese Patent Examined Publication No. 40757/1970, Japanese Patent O.P.I. Publication Nos. 1031/1972, 26133/1972, 94432/1973, 87650/1975, 3631/1976, 115219/1977, 99433/1979, 133329/1979 and 30127/1981, and U.S. Pat. Nos. 2,875,057, 3,253,924, 3,265,506, 3,408,194, 3,551,155, 3,551,156, 3,664,841, 3,725,072, 3,730,722, 3,891,445, 3,900,483, 3,929,484, 3,933,500, 3,973,968, 3,990,896, 4,012,259, 4,022,620, 4,029,508, 4,057,432, 4,106,942, 4,133,958, 4,269,936, 4,286,053, 4,304,845, 4,314,023, 4,366,327, 4,356,258, 4,386,155 and 4,401,752.
Representative examples of couplers which can be advantageously employed in the invention are given below.
A-1
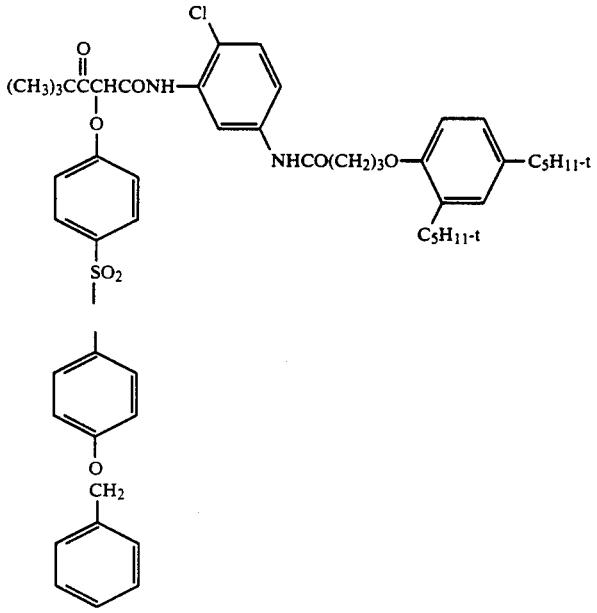
A-2
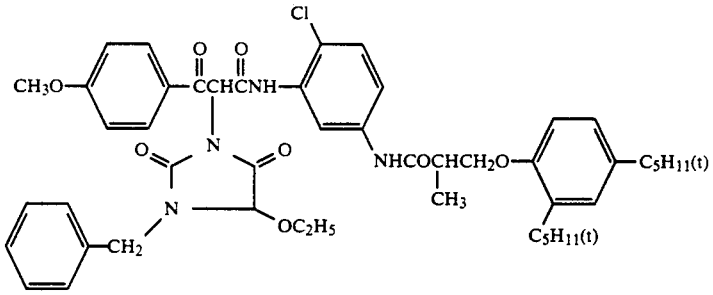
A-3
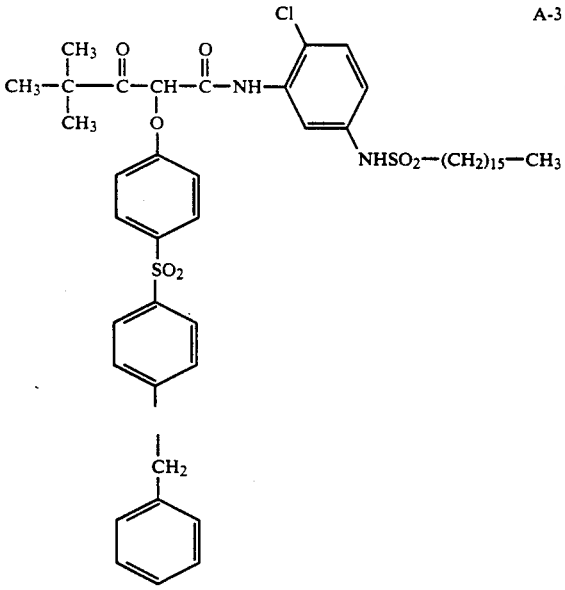
A-4
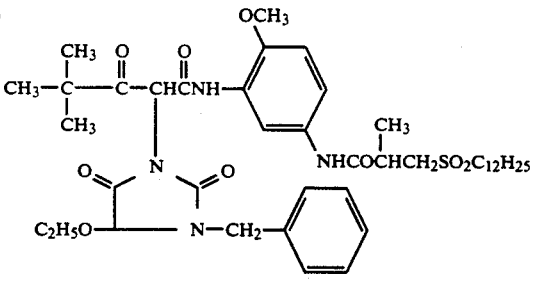

-continued
A-5
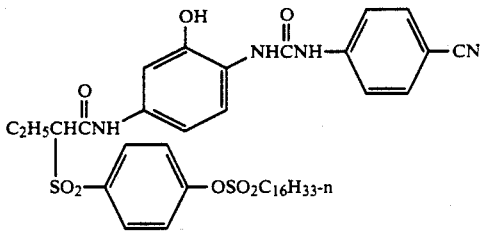
A-6
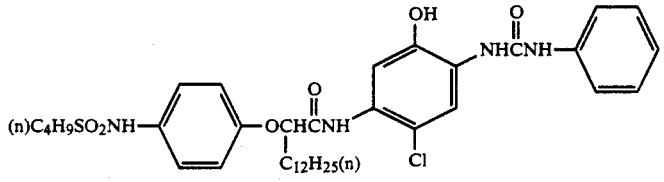
A-7
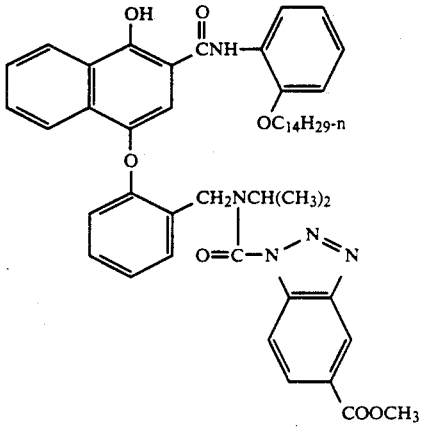
A-8
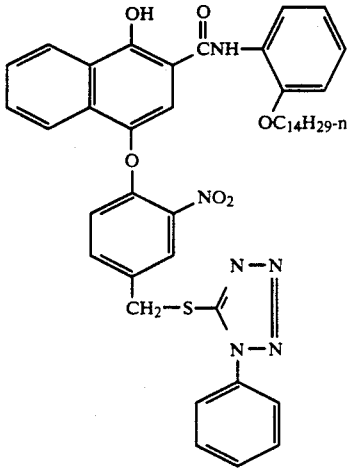
A-9
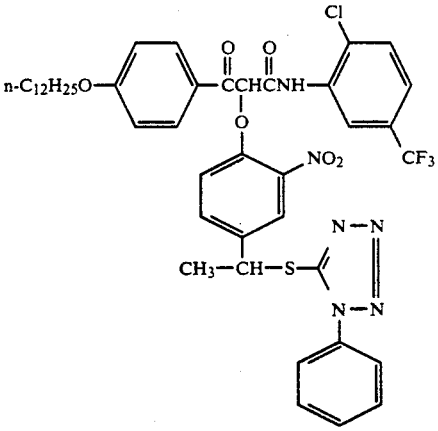
A-10
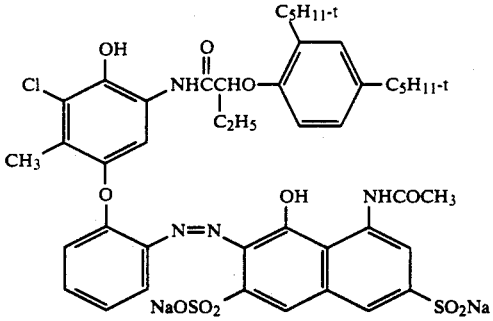
A-11
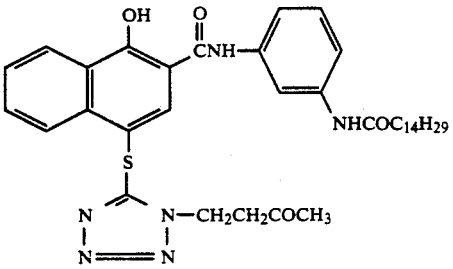
A-12
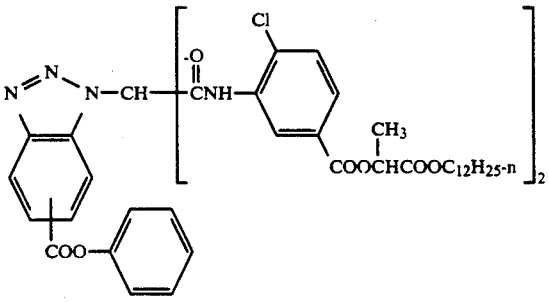

-continued
A-13
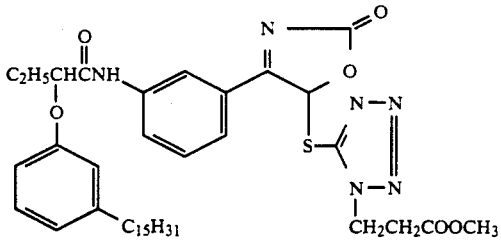
A-14
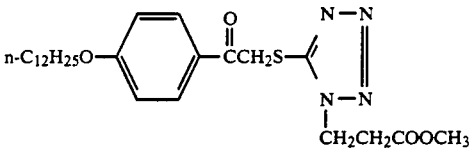
A-15
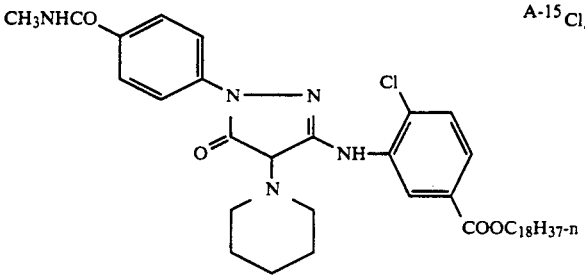
A-16
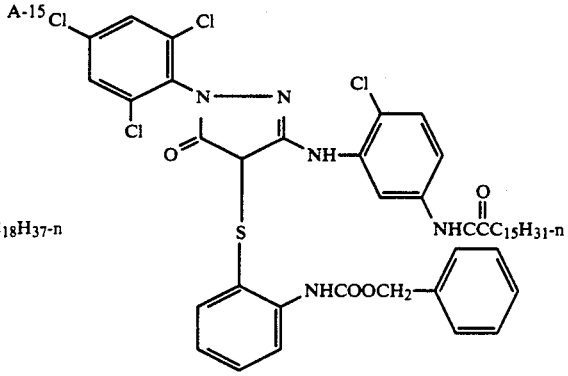
A-17
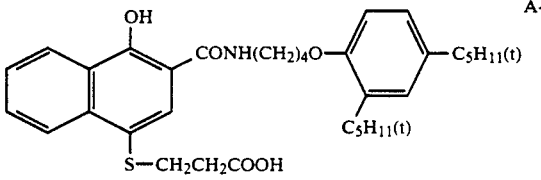
A-18
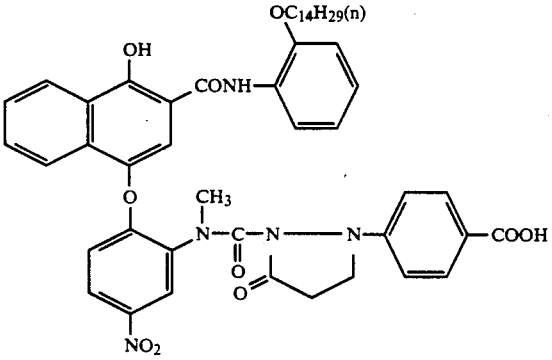
A-19
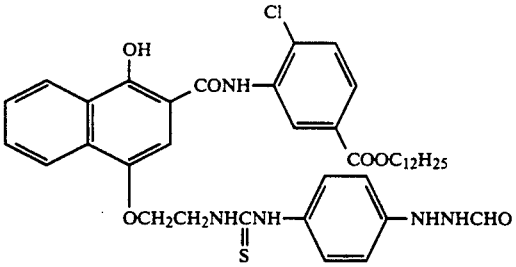
A-20
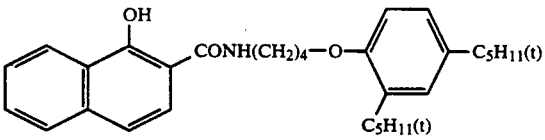
A-21
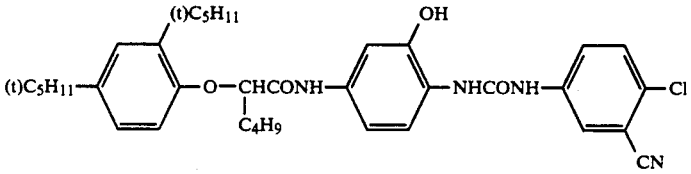

-continued
A-22
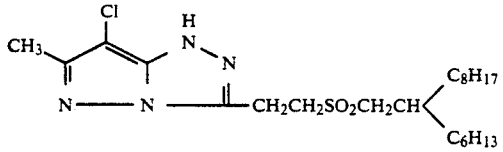
A-23
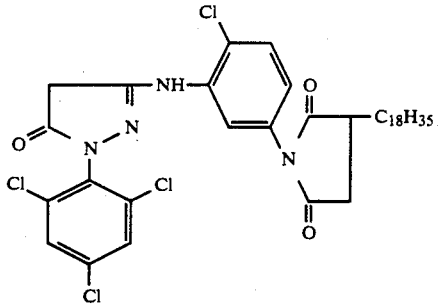
A-24
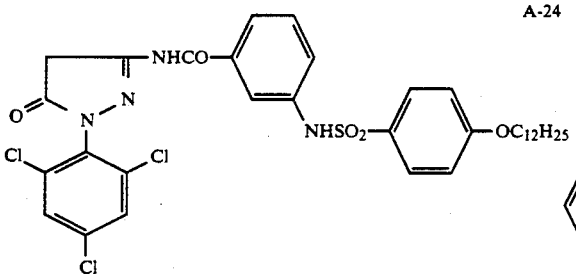
A-25
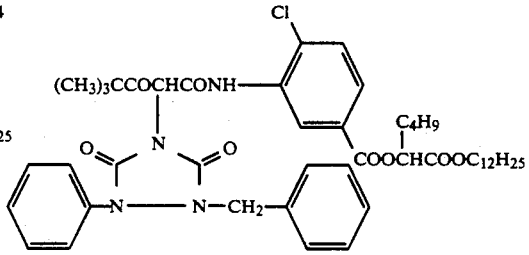
A-26
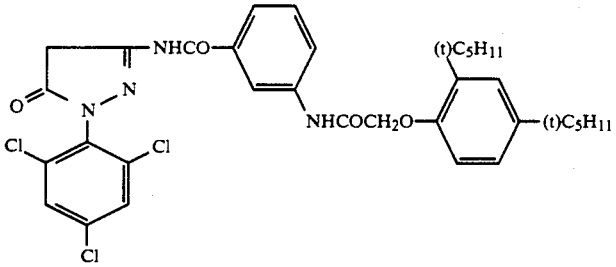
A-27
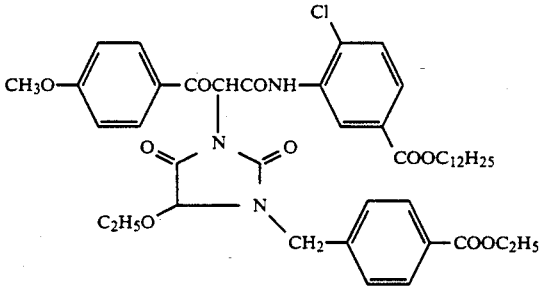
A-28
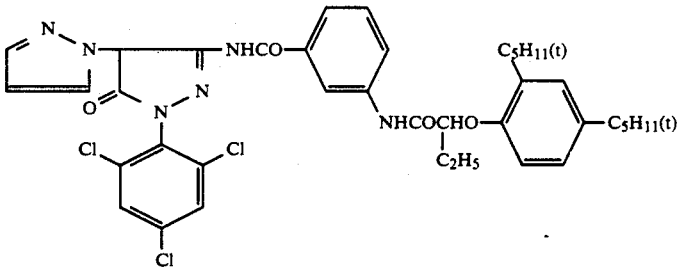
A-29
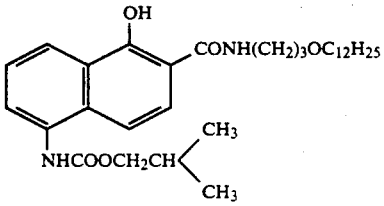
A-30
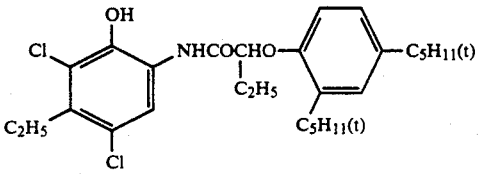

-continued
A-31
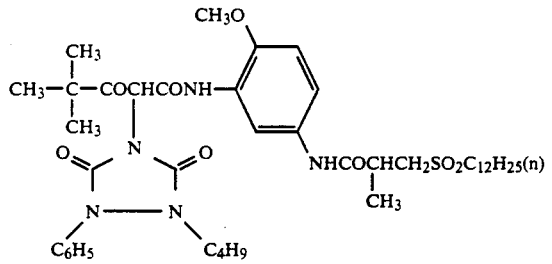
A-32
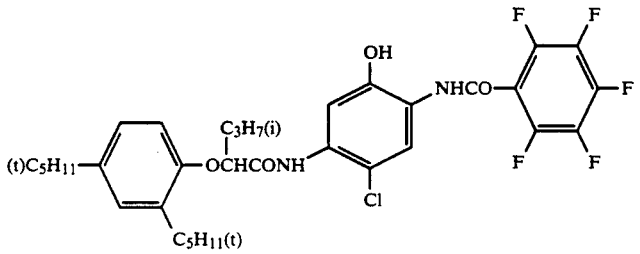
A-33
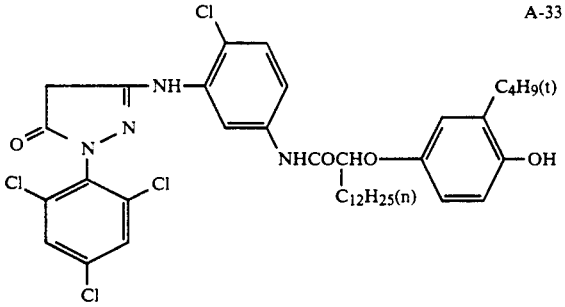
A-34
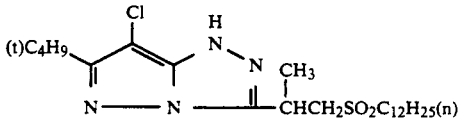
A-35
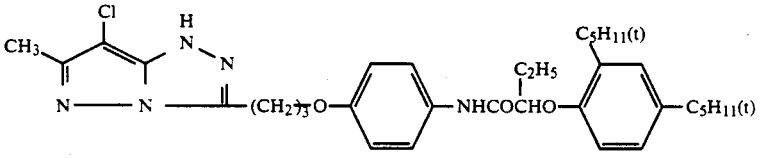
A-36
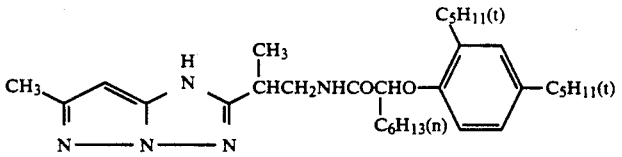
A-37
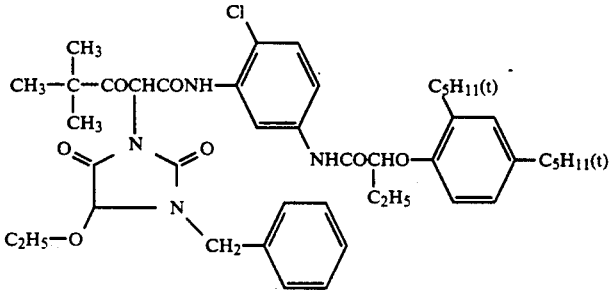

-continued
A-38
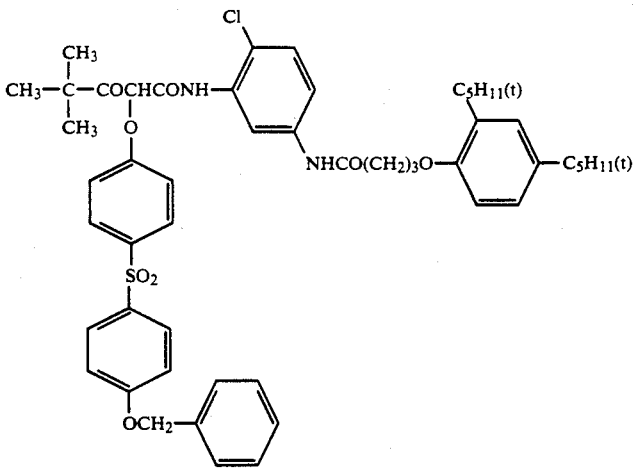
A-39
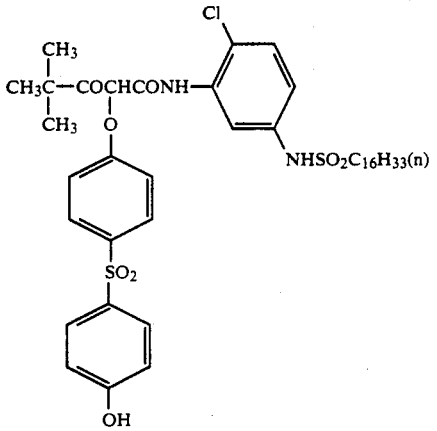
A-40
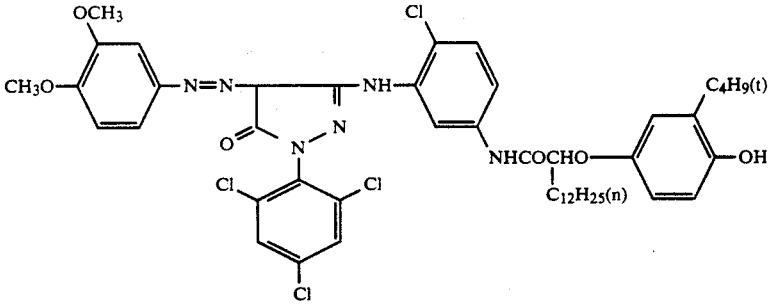
A-41
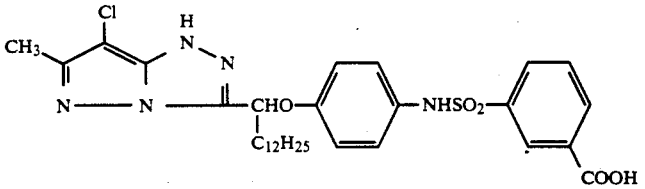
A-42
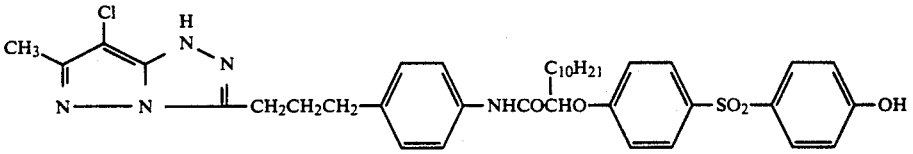

-continued

A-43

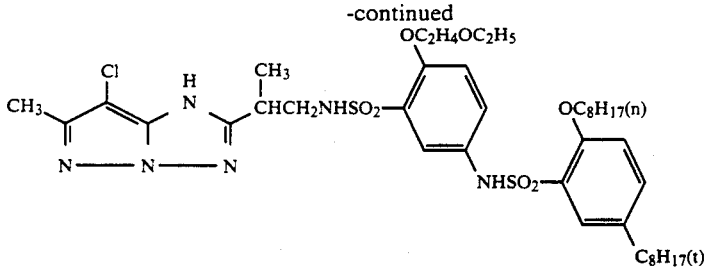

A-44

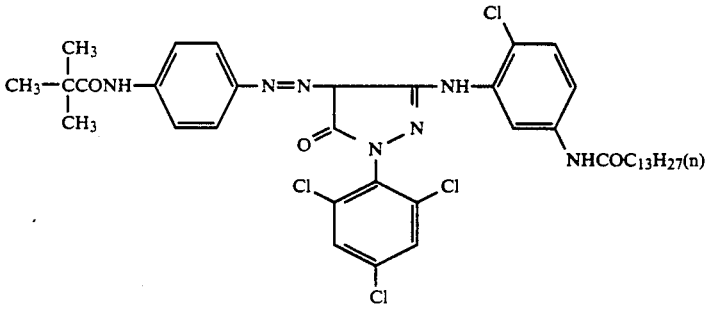

A-45

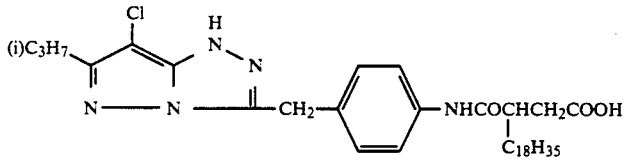

A-46

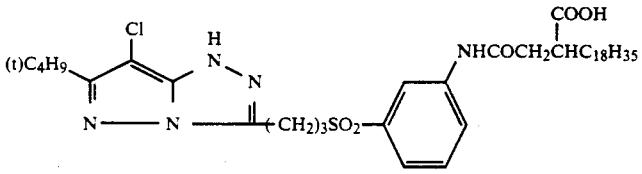

A-47

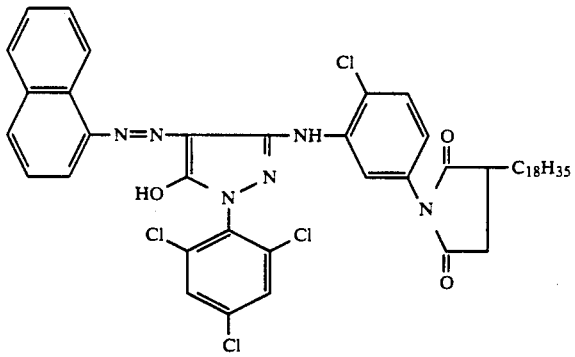

A-48

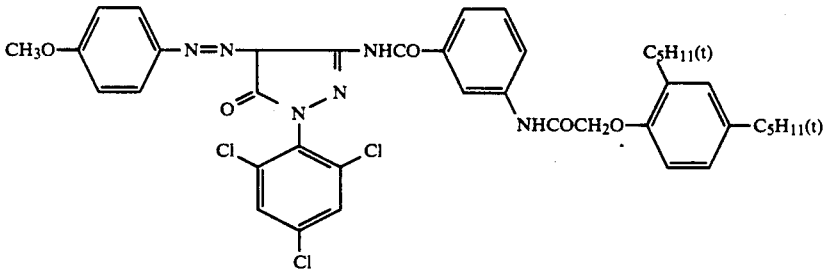

High-boiling solvents as referred to herein mean those which have conventionally been employed in the photographic industry, such as dibutylphthalate, di-2-ethylhexylphthalate, tricresylphosphate, diethyllaurylamide and dinonylphenol.

In the invention, the expression "containing substantially no high-boiling solvent" means containing a high-boiling solvent in an amount of 1.0 wt % or less, preferably 0.5 wt % or less, relative to the total amount of a coupler.

Though a high-boiling solvent is not used, a coupler can be dispersed by other methods such as deposition methods and mechanical grinding methods as mentioned below.

Deposition Method

When a coupler is soluble in a base: Dissolving a coupler in basic water, and adding the resulting solution to an acid liquid for dispersion.

When a coupler is soluble in an organic solvent: Dissolving a coupler in a water-miscible organic solvent, and adding the resulting solution to water for dispersion, or alternatively, dissolving a coupler in a non-water-miscible low-boiling organic solvent, making an oil-in-water type dispersion from the solution, and removing the solvent therefrom by distillation.

Specific examples of deposition methods are given below.

(1) A coupler is dissolved in a basic, hydrophilic colloidal solution containing a surfactant, followed by gradual addition of an acid to form a dispersion.

(2) A coupler is dissolved in a basic aqueous solution, and the resulting mixture is added to an acid hydrophilic solution gradually to form a dispersion.

(3) Methods proposed by H. H. Willard and L. Gordon (crystals are allowed to precipitate gradually from a homogeneous coupler solution)

(4) A coupler is dissolved in a water-miscible organic solvent, and the resulting mixture is added to a hydrophilic colloidal solution containing a surfactant to form a dispersion.

(5) A coupler is dissolved in a water-miscible organic solvent containing a surfactant, and the resulting mixture is added to a hydrophilic colloidal solution to form a dispersion.

(6) A coupler is dissolved in a non-water-miscible organic solvent, and the resulting mixture is mixed with a hydrophilic colloidal solution to form an oil-in-water type emulsion. The oil-in-water type emulsion is then changed to a water-in-oil type emulsion by a phase reversal method, followed by removal of the organic solvent therefrom by distillation.

These methods are described in more detail in the following publications.

U.S. Pat. No. 3,658,546 describes a method that comprises dissolving a coupler in ethyl acetate, adding the resulting solution to an aqueous solution of a surfactant to form a dispersion.

U.S. Pat. No. 2,870,012 describes a method that comprises dissolving a coupler that contains a carboxyl group or a group of its ester in a water-miscible organic solvent and mixing the resulting solution with an aqueous solution of a surfactant to form a coupler dispersion.

U.S. Pat. No. 2,991,177 and British Patent No. 1,009,414 each describe a method that comprises dissolving a hydrophobic coupler in dimethylformamide or tetrahydrothiophen-1,1-dioxide and mixing the resulting solution with an aqueous gelatin solution to form a coupler dispersion.

British Patent No. 1,193,349 and Research Disclosure No. 16,468 each describe a method that comprises dissolving a hydrophobic coupler in a mixture of methanol and an alkali, mixing the resulting solution with an aqueous gelatin solution, followed by neutralization to form a coupler dispersion.

U.S. Pat. No. 4,388,403 describes a method that comprises dissolving a hydrophobic coupler in a water-miscible organic solvent, and mixing the resulting solution with an aqueous solution of a hydrophilic polymer having a nonionic group and an ionic group to obtain a coupler dispersion.

Japanese Patent O.P.I. Publication No. 120,848/1990 describes a method comprising dissolving a hydrophobic coupler having an alkaline hydrolyzable group in a water-miscible organic solvent, and adding the resulting solution to water to obtain a coupler dispersion.

European Patent No. 374,837 describes a method comprising dissolving a hydrophobic coupler in a mixture of a water-miscible organic solvent and an alkali, and adding the resulting solution to water that contains an anionic surfactant and a nonionic polymer to form a dispersion. International Patent Application No. 90/08345 describes these dispersion processes.

Gelatin is employable as the hydrophilic colloid.

As the gelatin, lime-treated gelatin, acid-treated gelatin and oxygen-treated gelatin such as described in Bull, Soc, Sci, Photo, Japan No. 16, page 30 (1966) are usable. Hydrolyzed products and enzyme-decomposed products of gelatin are also usable.

In the invention, it is preferable to employ gelatin with a low calcium content. Such low-calcium gelatin can be prepared readily by subjecting normal gelatin to an ion exchange treatment. The calcium content is preferably not more than 1,000 ppm, more preferably not more than 800 ppm, most preferably not more than 600 ppm.

Any type of water-miscible organic solvent is usable, as long as it is capable of dissolving a coupler without causing decomposition of photographic reagents. Representative examples of usable water-miscible organic solvents include alcohols (e.g. methyl alcohol, ethyl alcohol, n-propyl alcohol, isopropyl alcohol, diacetone alcohol, ethylene glycol monobutylether); glycols (e.g. ethylene glycol, diethylene glycol, propylene glycol); cyclic ethers (e.g. dioxane, tetrahydrofuran); nitriles (e.g. acetonitrile); and amides (e.g. dimethylformamide); and N-methyl-2-pyrrolidone. Of them, n-propyl alcohol is preferable in respect of dispersion stability.

As the basic solution, alkaline solutions such as solutions of sodium hydroxide, potassium hydroxide, sodium carbonate, potassium carbonate, potassium citrate, lithium citrate, sodium acetate, potassium acetate or ammonia are usable.

The following substances are usable as the anionic surfactant.

$C_{12}H_{25}SO_3Na$ S-1

$C_{12}H_{25}OSO_3Na$ S-2

$C_{12}H_{25}CONHC_2H_4OSO_3Na$ S-3

$NaO_3S-CH(CH_2COOC_8H_{17})-COOC_8H_{17}$ S-4

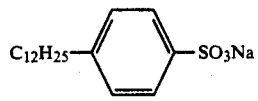

S-5

-continued

S-6

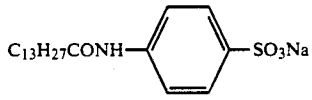

S-7

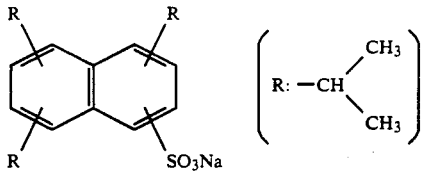

S-8

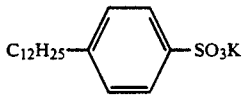

S-9

$C_{12}H_{25}O-(CH_2CH_2O)_{12}-SO_3Na$

S-10

$H-(CH_2)_l-O-(CH_2CH_2O)_m-CO-CH(CH_2COONa)-SO_3Na$ l: 10~12, m: 3~5

S-11

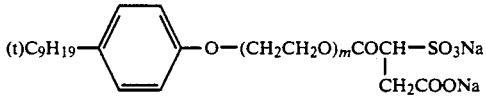

m: 5~10

S-12

$NaO_3S-CH(CH_2COOCH_2(CF_2CF_2)_nH)-COOCH_2(CF_2CF_2)_mH$ m: 2~3, n: 2~3

As the nonionic polymer, any type is usable in the invention, as long as it consists of polar groups and non-polar groups, and is capable of being linked to the head group of a surfactant and acting on a coupler in cooperation with the surfactant to prevent sizes of dispersed coupler particles from varying during storage. Representative examples of such polymer include polypropylene oxide, polyvinyl alcohol and methyl cellulose. In the invention, polyethylene oxide and polyvinyl pyrrolidone are preferable.

Mechanical Dispersion Methods

Dividing a coupler to fine particles by applying ultrasonic waves and other high energies thereto, followed by addition to a hydrophilic colloidal solution to form a dispersion.

Wetting a coupler with water or a poor solvent, and grinding it at a high temperature by means of a mill using a media with a narrow particle size distribution in the presence of a surfactant and/or a hydrophilic colloid.

These methods are described in more detail in the following publications.

Japanese Patent O.P.I. Publication Nos. 172,828/1989 and 110,547/1990 each describe a method comprising grinding a hydrophobic coupler by a ball mill or a sand mill in the presence of a surfactant and a hydrophilic colloid.

Mechanical dispersion can be performed by using ball mills, roll mills, sand mills and other mills. In the invention, sand mills are especially preferable. It is possible to use commercially available sand mills.

As the media, glass, alumina, zirconia, agate, stainless steel and nylon are suitable. In the invention, glass (in particular, one with a silicon dioxide content of not more than 60 wt %), zirconia, alumina are preferred. Media are preferably spherical. In this case, there is no restriction as to the size of media, but normally 0.1 to 20 mmϕ, preferably 0.2 to 10 mmϕ, most preferably 0.5 to 5.0 mmϕ.

Bright glass beads manufactured by Bright Labelling Co. Ltd. are one example of usable glass-made media.

For the dispersion of a coupler, it is especially preferable to employ a method described in European Patent No. 374837 or International Patent No. 90/08345.

In the invention, at least one of the silver halide emulsion layers comprises a silver halide emulsion in which silver halide grains prepared by a fine grain supplying method account for all or at least part of total silver halide grains contained therein. To say more exactly, the amount of silver halide grains prepared by this method accounts for preferably 10% or more, more preferably 20% or more, further more preferably 40% or more, most preferably 60% or more, of the total amount of silver halide grains contained therein.

The "fine grain supplying method" as referred to herein means a method in which formation of silver halide grains are performed by supplying small-sized silver halide grains. In this method, an aqueous solution of a halide salt or a silver salt may be supplied together with the fine grains of a silver halide (see Japanese Patent O.P.I. Publication No. 167537/1990). For increased uniformity of silver halide grains, it is preferable to supply silver halide fine grains alone.

Sizes of silver halide fine grains to be supplied are preferably 0.1 μm or less, more preferably 0.05 μm or less, most preferably 0.03 μm or less. The size of a silver halide grain can be obtained by taking an electron microphotograph (×30,000 to 60,000) of the grain and measuring the diameter of the grain appeared in the photograph. Alternatively, the size of a silver halide grain can be obtained by measuring the diameter of a circle having the same area as that of the projected image of the grain.

Silver halide fine grains may be supplied immediately after or after a while they have been formed by mixing a silver salt solution and a halide solution in a mixing apparatus. In the invention, the latter case is preferable, wherein the supply of silver halide fine grains may be performed either simultaneously with or prior to the formation (or growth) of silver halide light-sensitive grains.

In the invention, silver halide fine grains may or may not differ in halide composition. Only one type of silver halide fine grains being identical in halide composition may be supplied alone, or alternatively, two or more kinds of silver halide fine grains differing in halide composition may be employed in combination in an adequate amount ratio, and supplied either simultaneously or separately. In other words, to form silver halide grains with a desired silver iodide content, silver halide fine grains with such desired silver iodide content may be employed alone, or two or more kinds of silver halide fine grains differing in silver iodide content may be employed in combination in such an amount ratio as will permit the formation of silver halide grains with such desired silver iodide content. In the latter case, it is preferable that at least one kind of the silver halide grains has substantially a single halide composition.

It is preferred that a silver halide grain to be employed in the invention be of a core/shell structure (or a layered structure), in which a high silver iodide content layer (core layer) is present in the central portion of the grain, and surrounded by a low silver iodide content layer (shell layer) located at some distance from the center. In the case of a silver halide grain with such core/shell structure, the silver iodide content of a core layer is preferably 10 mol % or more, more preferably 15 to 45 mol %, further more preferably 20 to 40 mol %, most preferably 25 to 40 mol %; and the volume of a core layer account for preferably 10 to 80 mol %, more preferably 15 to 60 mol %, most preferably 15 to 45 mol %, of the total volume of the grain. The silver iodide content of a shell layer is preferably 15 mol % or less, more preferably 10 mol % or less, most preferably 5 mol % or less, and the volume of a shell layer account for preferably 3 to 70 mol %, more preferably 5 to 50 mol %, of the total volume of the grain. In the case of a silver halide grain with a core/shell structure, the silver iodide content of a core layer is larger than that of a shell layer by 5 mol % or more, more preferably by 10 mol % or more.

An intermediate layer may be present between a core layer (core layers) and a shell layer (shell layers), of which the silver iodide content is smaller than that of the core layer but larger than that of the shell layer. The volume of such intermediate layer accounts for preferably 5 to 70 mol %, more preferably 10 to 65 mol %, of the total volume of the grain. Other silver halide layers than core, intermediate and shell layers may be present between the center of a grain and the core layers, between the core layer and the intermediate layer and/or between the intermediate layer and the shell layer.

It is preferred that, in a core/shell-type silver halide grain to be employed in the invention, a shell layer (or shell layers) be surrounded by a layer of which the silver iodide content is higher than that of the shell layer (surface layer). In this case, the volume of such surface layer accounts for preferably 35% or less, more preferably 25% or less, most preferably 15% or less, of the total volume of the grain.

A silver halide grain to be employed in the invention may have any silver halide composition, as long as it contains silver iodide. Usable silver halides include silver iodobromide, silver chloroiodide, silver chloroiodobromide and mixtures thereof. Of them, silver iodobromide is most preferable.

In the invention, it is preferable to employ a silver halide emulsion which comprises silver iodobromide grains with an average silver iodide content of 4 to 20 mol %. Better results can be obtained when the average silver iodide content is 5 to 15 mol %.

In combination with a silver halide emulsion obtained by the aforementioned fine grain supplying method, conventional silver halide emulsions may be employed in the invention. Examples of such conventional silver halide emulsions include those described in Research Disclosure (hereinafter referred to as "RD") No. 308119. See below.

| [Item] | [RD308119 Page] |
|---|---|
| Silver iodohalide | 993 I-A |
| Method for preparation | 993 I-A and 994 E |
| Crystal habit | |
| Regular | 993 I-A |
| Twin | 993 I-A |
| Epitaxial | 993 I-A |
| Halogen composition | |
| Uniform | 993 I-B |

-continued

| [Item] | [RD308119 Page] |
|---|---|
| Not uniform | 993 I-B |
| Halide conversion | 994 I-C |
| Halide conversion substitution | 994 I-C |
| Doped metals | 994 I-D |
| Monodispersion | 995 I-F |
| Addition of solvent | 995 I-F |
| Position at which latent image is formed | |
| Surface | 995 I-G |
| Internal | 995 I-G |
| Light-sensitive material to which it is employed | |
| Negative | 995 I-H |
| Positive (including internally fogged grains) | 995 I-H |
| Blended use of two or more emulsions | 995 I-J |
| Desilvering | 995 II-A |

In the invention, it is preferred that silver halide emulsions be subjected to physical ripening, chemical and spectral sensitization. Examples of additives to be employed in these treatments are given in RD Nos. 17643, 18716 and 308119. See below.

| Item | [RD 308119 Page] | [RD 17643 Page] | [RD 18716 Page] |
|---|---|---|---|
| Chemical sensitizer | 996 III-A | 23 | 648 |
| Spectral sensitizer | 996 IV-A-A, B, C D, H, I, J | 23 to 24 | 648 to 9 |
| Super-sensitizer | 996 IV-A-E, J | 23 to 24 | 648 to 9 |
| Antifoggant | 998 VI | 24 to 25 | 649 |
| Stabilizer | 998 VI | 24 to 25 | 649 |

Photographic additives employable in the invention are also given in the above-mentioned Research Disclosures. See below.

| Item | [RD 308119 Page] | [RD 17643 Page] | [RD 18716 Page] |
|---|---|---|---|
| Anti-color-mixing agent | 1002 VII-I | 25 | 650 |
| Dye image stabilizer | 1001 VII-J | 25 | 650 |
| Brightening agent | 998 V | 24 | |
| UV absorber | 1003 VIII C, X III C | 25 to 26 | |
| Light absorber | 1003 VIII | 25 to 26 | |
| Light scattering agent | 1003 VIII | | |
| Filter dye | 1003 VIII | 25 to 26 | |
| Binder | 1003 IX | 26 | 651 |
| Anti-static agent | 1006 X III | 27 | 650 |
| Hardener | 1004 X | 26 | 651 |
| Plasticizer | 1006 X II | 27 | 650 |
| Lubricant | 1006 X II | 27 | 650 |
| Surface-activating agent/coating aid | 1005 X I | 26 to 27 | 650 |
| Matting agent | 1007 X VI | | |
| Developing agent (containing in a light-sensitive material) | 1011 X X-B | | |

Various couplers may be employed in the invention. Examples of usable additives are given in RD Nos. 308119 and 17643. See below.

| Item | [RD 308119 Page] | [RD 17643 Page] |
|---|---|---|
| Colored coupler | 1002 VII-G | VII-G |
| DIR coupler | 1001 VII-F | VII F |
| BAR coupler | 1002 VII-F | |
| Other couplers capable of releasing photographically useful groups. | 1001 VII-F | |
| Alkaline-soluble coupler | 1001 VII-E | |

In the invention, additives can be added according to methods described in RD No. 308119 XIV.

In the invention, supports described in RD No. 17643, page 28, RD No. 18716, pages 647 to 648 and RD No. 308119, XIX may be employed.

The silver halide light-sensitive material of the invention may be provided with auxiliary layers such as a filter layer or an intermediate layer (see RD No. 308119, VII-K).

The silver halide light-sensitive material of the invention may be of either conventional layer structure, inverted layer structure or unit layer structure.

The present invention can be applied to various color photographic light-sensitive materials, including color negative films for normal photography and movies, color reversal films for TV and slides, color positive films and color reversal paper.

The light-sensitive material of the invention can be processed by conventional methods described in RD No. 17643, pages 28 to 29, RD No. 18716, page 647 and RD No. 308119, XIX.

EXAMPLES

The present invention will be described in more detail according to the following examples.

EXAMPLE 1

Preparation of EM-A to D

Preparation of EM-A, an Emulsion Comprising Tabular, Hexagonal Silver Iodobromide Grains An emulsion comprising tabular, hexagonal silver iodobromide grains was prepared using an emulsion comprising hexagonal silver halide grains with an average grain size of 0.70 μm, an average aspect ratio of 3 and an average silver iodide content of 20 mol % as a seed grain emulsion. Here, the grain size is the diameter of a circle having the same area. The method of preparation will be explained below.

To Solution G-10 that had been put in a reactor, a 1.57 mol Ag-equivalent amount of the seed emulsion was added with stirring, while keeping the temperature, pAg and pH of G-10 at 65° C., 9.7 and 6.8, respectively. Then, Solutions H-10 and S-10 were added to the reactor by a double-jet method over a period of 58 minutes. The flow rates of H-10 and S-10 were increased with time, but the ratio of the flow rate of H-10 to that of S-10 was kept at 1:1.

During the addition of H-10 and S-10, pAg and pH were controlled by adding an aqueous potassium bromide solution and an aqueous potassium hydroxide solution to the reactor.

Grains formed in the reactor were then desalted by flocculation. Then, gelatin was added to make them re-dispersed. pH and pAg were adjusted to 5.8 and 8.06, respectively, at 40° C.

As a result, there was obtained a monodispersed emulsion comprising tabular, hexagonal silver iodobromide grains with an average grain size of 1.38 μm, an average aspect ratio of 4, a variation coefficient of 13.8% and an average silver iodide content of 8.5 mol %. This emulsion was designated as EM-A.

Preparation of EM-B, an Emulsion Comprising Tabular, Hexagonal Silver Iodobromide Grains EM-B was prepared in substantially the same manner as that employed in the preparation of EM-A, except that an emulsion comprising tabular silver iodobromide grains with an average silver iodide content of 8 mol % was employed as the seed emulsion, and that Solution H-11 was used instead of Solution H-10.

As a result, there was obtained a monodispersed emulsion comprising tabular, hexagonal silver iodobromide grains with an average grain size of 1.38 μm, a variation coefficient of 13.6% and an average silver iodide content of 8.0 mol %.

Preparation of EM-C, an Emulsion Comprising Tabular, Hexagonal Silver Iodobromide Grains An emulsion comprising tabular, hexagonal silver iodobromide grains was prepared using an emulsion comprising hexagonal silver halide grains with an average grain size of 0.70 μm, an average aspect ratio of 3 and an average silver iodide content of 20 mol % as the seed grain emulsion. The method of preparation will be explained below.

To Solution G-10 that had been put in a reactor, a 1.57 mol Ag-equivalent amount of the seed emulsion was added with stirring, while keeping the temperature, pAg and pH of G-10 at 65° C., 9.7 and 6.8, respectively. Then, 7.26 mol of ammonium acetate was added to the reactor. Next, silver halide fine grains were formed in a mixing apparatus provided near the reactor, and supplied to the reactor continuously by the following method.

To a mixing apparatus provided near the reactor, Solutions G-20, H-20 and S-20 were added under pressure by a triple-jet method over a period of 93 minutes. The flow rates of these solutions were increased with time. From the mixing apparatus, an emulsion containing silver halide fine grains was continuously supplied to the reactor. The amount of the emulsion supplied to the reactor was varied in proportion to the amounts of solutions added to the mixing apparatus.

During the addition of G-20, H-20 and S-20, the temperature of the mixing apparatus was kept at 40° C., and the revolution speed of the stirring blade was maintained at 4,000 rpm. Silver halide fine grains supplied to the reactor had grain sizes of 0.015 μm.

pH and pAg of the liquid in the reactor were adjusted by the addition of an aqueous potassium bromide solution and an aqueous potassium hydroxide solution.

The formed silver halide grains were desalted by flocculation, followed by re-dispersion in gelatin. pH and pAg of the dispersion was adjusted to 5.8 and 8.06, respectively, at 40° C.

As a result, there was obtained a monodispersed emulsion comprising tabular, hexagonal silver iodobromide grains with an average grain size of 1.38 μm, a variation coefficient of 13.1% and an average silver iodide content of 8,5 mol %. This emulsion was designated as EM-C.

Preparation of EM-D, an Emulsion Comprising Tabular, Hexagonal Silver Iodobromide Grains EM-D was prepared in substantially the same manner as that employed in the preparation of EM-C, except that an emulsion comprising tabular silver iodobromide grains with an average silver iodide content of 8 mol % was used as the seed emulsion, and that Solution H-21 was used in place of H-20.

As a result, there was obtained a monodispersed emulsion comprising tabular, hexagonal silver iodobromide grains with an average grain size of 1.38 μm, a variation coefficient of 12.8% and an average silver iodide content of 8.0 mol %.

| | |
|---|---|
| < G-10 > | |
| Ossein gelatin | 120.0 g |
| (average molecular weight: 100,000) | |
| Compound I | 25.0 ml |
| 28% aqueous ammonia solution | 440.0 ml |
| 56% aqueous acetic acid solution | 660.0 ml |
| Water was added to make the total quantity | 4000.0 ml |
| Compound I: a 10% aqueous solution of a sodium polyisopropylene polyoxydisuccinate | |
| < H-10 > | |
| Potassium bromide | 812.2 g |
| Potassium iodide | 72.3 g |
| Water was added to make the total quantity | 2074.3 ml |
| < S-10 > | |
| Silver nitrate | 1233.3 g |
| 28% aqueous ammonia solution | equivalent amount |
| Water was added to make the total quantity | 2074.3 ml |
| < H-11 > | |
| Potassium bromide | 794.9 g |
| Potassium iodide | 96.4 g |
| Water was added to make the total quantity | 2074.3 ml |
| < G-20 > | |
| Ossein gelatin | 300.0 g |
| (average molecular weight: 40,000) | |
| Water was added to make the total quantity | 2000.0 ml |
| < H-20 > | |
| Potassium bromide | 812.2 g |
| Potassium iodide | 72.3 g |
| Water was added to make the total quantity | 2000.0 ml |
| < S-20 > | |
| Silver nitrate | 1233.3 g |
| Water was added to make the total quantity | 2000.0 ml |
| < H-21 > | |
| Potassium bromide | 794.9 g |
| Potassium iodide | 96.4 g |
| Water was added to make the total quantity | 2000.0 ml |

Preparation of EM-1 to 3

Preparation of EM-1, an Emulsion Comprising Octagonal Silver Iodobromide Grains

An emulsion comprising octagonal silver iodobromide grains was prepared according to a double-jet method and by using, as seed crystals, monodispersed silver iodobromide grains with an average grain size of 0.33 μm and an average silver iodide content of 2 mol %. The method of preparation will be explained below.

To Solution G-1 that had been heated to 70° C. and adjusted to have pAg and pH values of 7.8 and 7.0, respectively, a 0.34 mol Ag-equivalent amount of seed crystals were added with vigorous stirring.

Then, Solutions H-1 and S-1 were added to the reaction mixture over a period of 86 minutes. The flow rates of H-1 and S-1 were increased with time, so that those at the final stage of addition were 3.6 times higher than those at the initial stage. The ratio of the flow rate of H-1 to that of S-1 was kept at 1:1. A core layer, a high iodide content layer in the central part, was formed in each grain by this step.

Subsequently, Solutions H-2 and S-2 were added to the reaction liquid over a period of 65 minutes. During the addition, pAg and pH were kept at 10.1 and 6.0, respectively. The flow rates of H-2 and S-2 were increased with time, so that those at the final stage of addition were 5.2 times higher than those at the initial stage. The ratio of the flow rate of H-2 to that of S-2 was maintained at 1:1. A shell layer, a low iodide content layer surrounding the core layer, was formed in each grain by this step.

During the formation of grains, pAg and pH of the reaction liquid were controlled with an aqueous potassium bromide solution and a 56% aqueous acetic acid solution.

The formed grains were rinsed with water for flocculation, and gelatin was added for re-dispersion. pH and pAg of the dispersion were adjusted to 5.8 and 8.06, respectively, at 40° C.

As a result, there was obtained a monodispersed emulsion comprising octagonal silver iodobromide grains with an average size of 0.99 μm, a variation coefficient of 12.4% and an average silver iodide content of 8.5 mol %. This emulsion was designated as EM-1.

| | |
|---|---|
| < G-1 > | |
| Ossein gelatin | 100.0 g |
| Compound I* | 25.0 ml |
| 28% aqueous ammonia solution | 440.0 ml |
| 56% aqueous acetic acid solution | 660.0 ml |
| Water was added to make the total quantity | 5,000.0 ml |
| < H-1 > | |
| Ossein gelatin | 82.4 g |
| Potassium bromide | 151.6 g |
| Potassium iodide | 90.6 g |
| Water was added to make the total quantity | 1030.5 ml |
| < S-1 > | |
| Silver nitrate | 309.2 g |
| 28% aqueous ammonia solution | equivalent amount |
| Water was added to make the total quantity | 1030.5 ml |
| < H-2 > | |
| Ossein gelatin | 302.1 g |
| Potassium bromide | 770.0 g |
| Potassium iodide | 33.2 g |
| Water was added to make the total quantity | 3776.8 ml |
| < S-2 > | |
| Silver nitrate | 1133.0 g |
| 28% aqueous ammonia solution | equivalent amount |
| Water was added to make the total quantity | 3776.8 ml |

*Compound I was the same as that employed in the preparation of EM-A.

Preparation of MC-1, an Emulsion Comprising Silver Bromide Fine Grains

To 5,000 ml of a 9.6 wt % gelatin solution containing 0.05 mol of potassium bromide, 2,500 ml of an aqueous solution containing 10.6 mol of silver nitrate and 2,500 ml of an aqueous solution containing 10.6 mol of potassium bromide were added for a period of 28 minutes. The flow rates of these aqueous solutions were increased with time so that those at the final stage of addition were 5 times higher than those at the initial stage. During the addition, the temperature of the reaction liquid was kept at 35° C.

Observation of an electron microphotograph (×60,000) of the resulting silver bromide fine grains revealed that these grains had an average grain size of 0.032 μm. The silver halide fine grains were stored in a storage vessel. (Preparation of MC-2, an emulsion comprising silver iodide fine grains)

To 5,000 ml of a 9.6 wt % gelatin solution containing 0.05 mol of potassium iodide, 2,500 ml of an aqueous solution containing 10.6 mol of silver nitrate and 2,500 ml of an aqueous solution containing 10.6 mol of potassium iodide were added for a period of 28 minutes. The flow rates of these aqueous solutions were increased with time so that those at the final stage of addition were 5 times higher than those at the initial stage. During the addition, the temperature of the reaction liquid was kept at 35° C.

Observation of an electron microphotograph (×60,000) of the resulting silver iodide fine grains revealed that these grains had an average grain size of 0.027 μm. The fine grains were stored in a storage vessel.

Preparation of MC-3, an Emulsion Comprising Silver Iodobromide Fine Grains

To 5,000 ml of a 9.6 wt % gelatin solution containing 0.05 mol of potassium bromide, 2,500 ml of an aqueous solution containing 10.6 mol of silver nitrate and 2,500 ml of an aqueous solution containing 10.28 mol of potassium bromide and 0.31 mol of potassium iodide were added for a period of 28 minutes. The flow rates of these aqueous solutions were increased with time so that those at the final stage of addition were 5 times higher than those at the initial stage. During the addition, the temperature of the reaction liquid was kept at 35° C.

Observation of an electron microphotograph (×60,000) of the resulting silver iodobromide fine grains revealed that these grains had an average grain size of 0.032 μm.

Preparation of EM-2, an Emulsion Comprising Octagonal Silver Iodobromide Grains An emulsion comprising octagonal silver iodobromide grains was prepared by using monodispersed silver iodobromide grains (silver iodide content: 2 mol %) with an average grain size of 0.33 μm as seed crystals and by supplying silver halide fine grains which had been stored in a storage vessel. The method of preparation will be explained below.

To solution G-1 which had been heated to 70° C. and adjusted to have pAg and pH values of 7.8 and 7.0, respectively, 144.4 ml of a 0.34 mol-equivalent amount of the seed emulsion was added with vigorous stirring. Then, a 8.83 mol-equivalent amount of an aqueous ammonium acetate solution was added.

Subsequently, the above-obtained MC-1 and MC-2 were added to the reaction liquid over a period of 86 minutes. The flow rates of MC-1 and 2 were increased with time so that those at the final stage of addition were 3.6 times higher than those at the initial stage. The ratio of the flow rate of MC-1 to that of MC-2 was kept at 70:30. A core layer, a high iodide content layer in the central part, was formed by this step. The total amount of consumed fine grains during this period was equivalent to 1.82 mol.

To the reaction liquid of which the pAg and the pH were kept at 10.1 and 6.0, respectively, MC-1 and MC-2 were added over a period of 65 minutes. The flow rates of MC-1 and M-2 were increased with time so that those at the final stage of addition were 5.2 times higher than those at the initial stage. The ratio of the flow rate of MC-1 to that of MC-2 was kept at 97:3. A shell layer, a low iodide content layer surrounding the core layer, was formed by this step. The total amount of consumed fine grains during this period was equivalent to 6.67 mol.

During the formation of grains, pH was controlled with a 28% aqueous ammonia solution.

The so-obtained grains were subjected to rinsing and pAg/pH adjustment by the same methods as those employed in the preparation of EM-1.

As a result, there was obtained a monodispersed emulsion comprising octagonal silver iodobromide grains with an average grain size of 0.99 μm, a variation coefficient of 10.7% and an average silver iodide content of 8.5 mol %. This emulsion was designated as EM-2.

Preparation of EM-3, an Emulsion Comprising Octagonal Silver Iodobromide Grains EM-3 was prepared in substantially the same manner as that employed in the preparation of EM-1 or 2. The method of preparation will be explained below.

To solution G-1 which had been heated to 70° C. and adjusted to have pAg and pH values of 7.8 and 7.0, respectively, 144.4 ml of a 0.34 mol-equivalent amount of the seed emulsion was added with vigorous stirring.

A core layer was formed in substantially the same manner as that employed in the preparation of EM-1. During the formation of the core year, pAg and pH were adjusted with an aqueous potassium bromide solution and a 56% aqueous acetic acid solution.

Then, a 6.67 mol-equivalent amount of ammonium acetate solution was added to the reaction liquid. While keeping pAg and pH at 10.1 and 6.0, respectively, MC-3 was added for a period of 65 minutes. The flow rate of MC-3 was increased with time so that at the final stage of addition was 5.2 times higher than that at the initial stage. The amount of fine grains consumed during this period was equivalent to 6.67 mol. A shell layer was formed by this step. During the formation of the shell layer, pH was adjusted with a 28% aqueous ammonia solution.

The formed grains were subjected to desalting and pAg/pH adjustment by the same methods as those employed in the preparation of EM-1.

As a result, there was obtained a monodispersed emulsion comprising octagonal silver iodobromide grains with an average grain size of 0.99 μm, a variation coefficient of 10.6% and an average silver iodide content of 8.5 mol %. This emulsion was designated as EM-3.

Preparation of Silver Halide Photographic Light-Sensitive Materials

EM-A to E, and EM-1 to 3 were each subjected to chemical sensitization and spectral sensitization to an optimum level. Using these emulsions, layers with the following compositions were provided in sequence on a triacetyl cellulose film support, whereby a multi-layer color photographic light-sensitive material (Comparative Sample No. 101) was obtained.

In the following examples, the amounts of ingredients were expressed in terms of gram per square meter of a light-sensitive material, unless otherwise indicated. The amounts of silver halide and colloidal silver were each indicated as the amount of silver contained therein.

| 1st Layer: Anti-halation layer (HC) | |
|---|---|
| Black colloidal silver | 0.15 |

-continued

| | |
|---|---|
| UV absorber (UV-1) | 0.20 |
| Colored coupler (CC-1) | 0.02 |
| High boiling solvent (Oil-1) | 0.20 |
| High boiling solvent (Oil-2) | 0.20 |
| Gelatin | 1.6 |
| 2nd Layer: Intermediate layer (IL-1) | |
| Gelatin | 1.3 |
| 3rd Layer: Low-speed red-sensitive emulsion layer (R-L) | |
| Silver iodobromide emulsion (average grain size: 0.3 μm) | 0.4 |
| Silver iodobromide emulsion (average grain size: 0.4 μm) | 0.3 |
| Sensitizing dye (S-1) | $3.2 \times 10^{-4}$ mol per mol silver |
| Sensitizing dye (S-2) | $3.2 \times 10^{-4}$ mol per mol silver |
| Sensitizing dye (S-3) | $0.2 \times 10^{-4}$ mol per mol silver |
| Cyan coupler (C-1) | 0.50 |
| Cyan coupler (C-2) | 0.13 |
| Colored cyan coupler (CC-1) | 0.07 |
| DIR compound (D-1) | 0.006 |
| DIR compound (D-2) | 0.01 |
| High-boiling solvent (Oil-1) | 0.55 |
| Gelatin | 1.0 |
| 4th Layer: High-speed red-sensitive emulsion layer (R-H) | |
| Silver iodobromide emulsion (average grain size: 0.7 μm) | 0.9 |
| Sensitizing dye (S-1) | $1.7 \times 10^{-4}$ mol per mol silver |
| Sensitizing dye (S-2) | $1.6 \times 10^{-4}$ mol per mol silver |
| Sensitizing dye (S-3) | $0.1 \times 10^{-4}$ mol per mol silver |
| Cyan coupler (C-2) | 0.23 |
| Colored cyan coupler (CC-1) | 0.03 |
| DIR compound (D-2) | 0.02 |
| High-boiling solvent (Oil-1) | 0.25 |
| Gelatin | 1.0 |
| 5th Layer: Intermediate layer (IL-2) | |
| Gelatin | 0.8 |
| 6th Layer: Low-speed green-sensitive emulsion layer (G-L) | |
| Silver iodobromide emulsion (average grain size: 0.4 μm) | 0.6 |
| Silver iodobromide emulsion (average grain size: 0.3 μm) | 0.2 |
| Sensitizing dye (S-4) | $6.7 \times 10^{-4}$ mol per mol silver |
| Sensitizing dye (S-5) | $0.8 \times 10^{-4}$ mol per mol silver |
| Magenta coupler (M-1) | 0.60 |
| Colored magenta coupler (CM-1) | 0.10 |
| DIR compound (D-3) | 0.02 |
| High-boiling solvent (Oil-2) | 0.7 |
| Gelatin | 1.0 |
| 7th Layer: High-speed green-sensitive emulsion layer (G-H) | |
| Silver iodobromide emulsion (EM-A) | 0.9 |
| Sensitizing dye (S-6) | $1.1 \times 10^{-4}$ mol per mol silver |
| Sensitizing dye (S-7) | $2.0 \times 10^{-4}$ mol per mol silver |

-continued

| | |
|---|---|
| Sensitizing dye (S-8) | $2.0 \times 10^{-4}$ mol per mol silver |
| Magenta coupler (M-1) | 0.16 |
| Colored magenta coupler (CM-1) | 0.04 |
| DIR compound (D-3) | 0.004 |
| High-boiling solvent (Oil-2) | 0.35 |
| Gelatin | 1.0 |
| 8th Layer: Yellow filter layer (YC) | |
| Yellow colloidal silver | 0.1 |
| Additive (HS-1) | 0.07 |
| Additive (HS-2) | 0.07 |
| Additive (SC-1) | 0.12 |
| High-boiling solvent (Oil-2) | 0.15 |
| Gelatin | 1.0 |
| 9th Layer: Low-speed blue-sensitive emulsion layer (B-H) | |
| Silver iodobromide emulsion (average grain size: 0.3 μm) | 0.25 |
| Silver iodobromide emulsion (average grain size: 0.4 μm) | 0.25 |
| Sensitizing dye (S-9) | $5.8 \times 10^{-4}$ mol per mol silver |
| Yellow coupler (Y-1) | 0.6 |
| Yellow coupler (Y-2) | 0.32 |
| DIR compound (D-1) | 0.003 |
| DIR compound (D-2) | 0.006 |
| High-boiling solvent (Oil-2) | 0.18 |
| Gelatin | 1.3 |
| 10th Layer: High-speed blue-sensitive emulsion layer (B-H) | |
| Silver iodobromide emulsion (average grain size: 0.8 μm) | 0.5 |
| Sensitizing dye (S-10) | $3 \times 10^{-4}$ mol per mol silver |
| Sensitizing dye (S-11) | $1.2 \times 10^{-4}$ mol per mol silver |
| Yellow coupler (Y-1) | 0.18 |
| Yellow coupler (Y-2) | 0.10 |
| High-boiling solvent (Oil-2) | 0.05 |
| Gelatin | 1.0 |
| 11th Layer: 1st protective layer (PRO-1) | |
| Silver iodobromide emulsion (average grain size: 0.08 μm) | 0.3 |
| UV absorber (UV-1) | 0.07 |
| UV absorber (UV-2) | 0.10 |
| Additive (HS-1) | 0.2 |
| Additive (HS-2) | 0.1 |
| High-boiling solvent (Oil-1) | 0.07 |
| High-boiling solvent (Oil-3) | 0.07 |
| Gelatin | 0.8 |
| 12th Layer: 2nd Protective layer (PRO-2) | |
| Alkaline-soluble matting agent (average grain size: 2 μm) | 0.13 |
| Polymethylmethacrylate (average grain size: 3 μm) | 0.02 |
| Gelatin | 0.5 |

Besides the above ingredients, surfactants (Su-1 and Su-2), a viscosity controller, hardeners (H-1 and H-2), a stabilizer (ST-1), an anti-foggant (AF-1 and AF-2; two kinds of AF-2 were employed. One had an average molecular weight of 10,000 and the other 1,100,000) and a compound (DI-1) were employed. The amount of DI-1 was 9.4 mg/m$^2$.

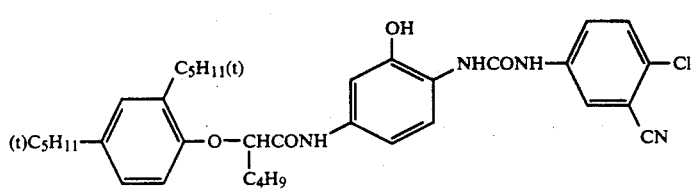

C-1

-continued
C-2
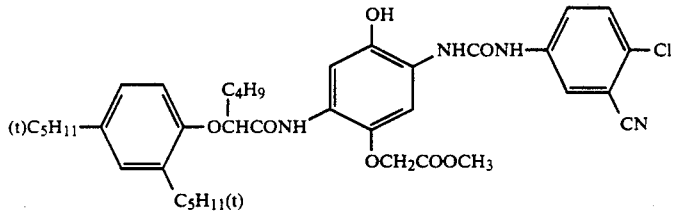
M-1
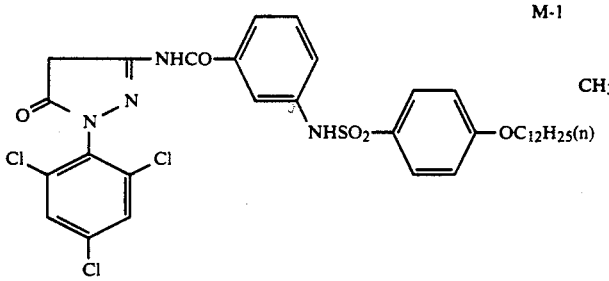
Y-1
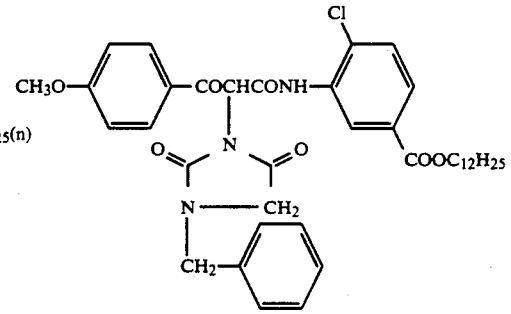
Y-2
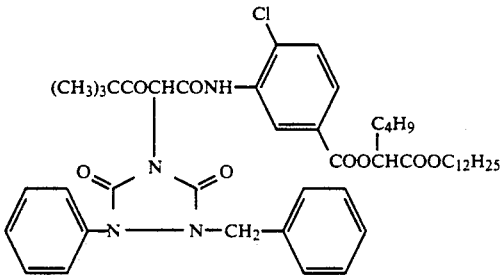
CC-1
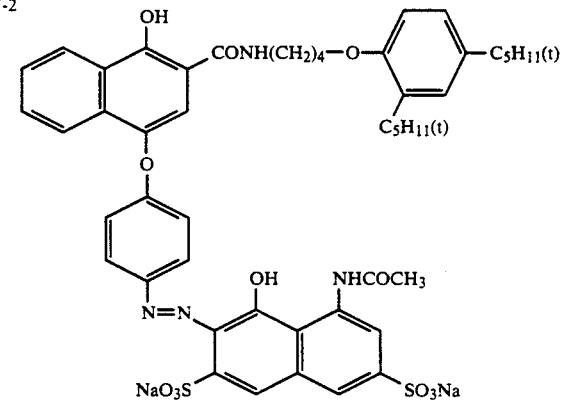
CM-1
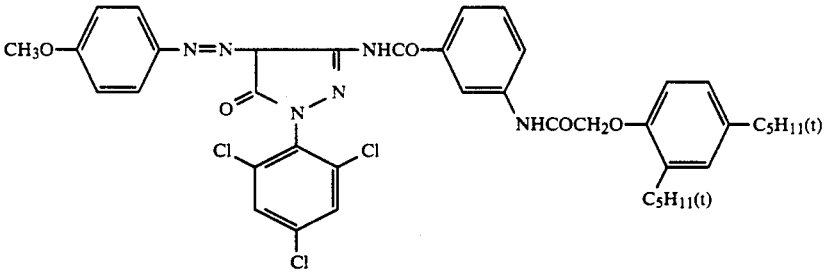
D-1
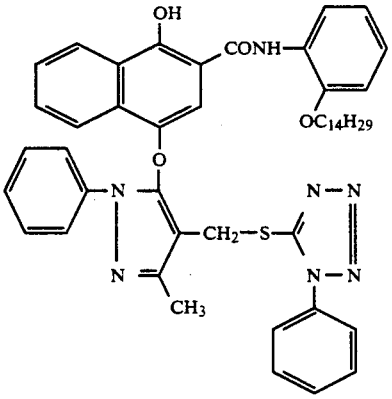
D-2
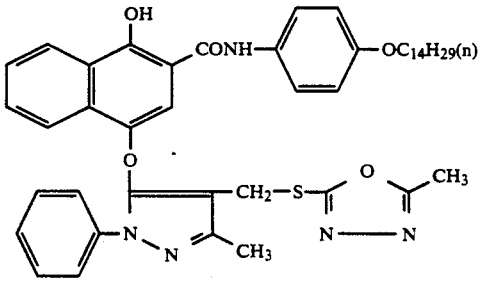

-continued
D-3
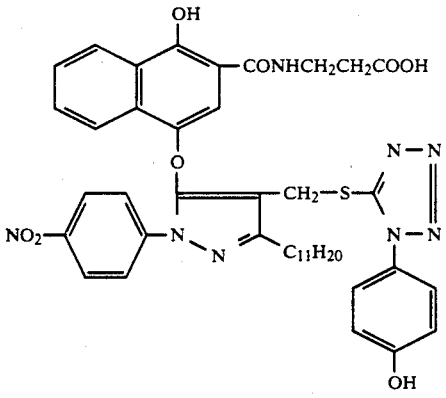
UV-1
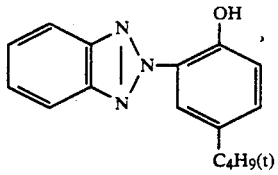
UV-2
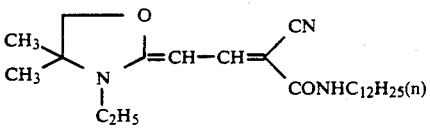
S-1
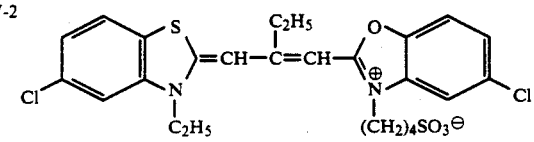
S-2
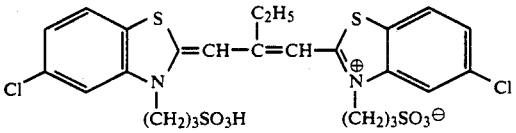
S-3
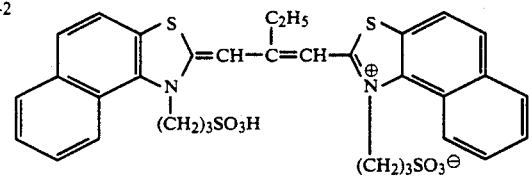
S-4
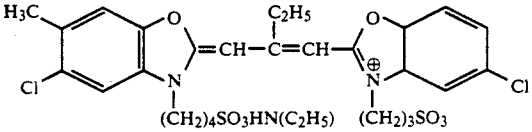
S-5
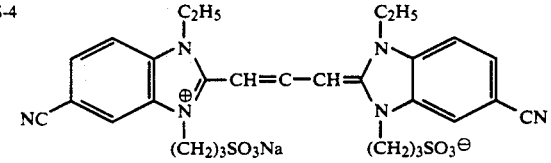
S-6
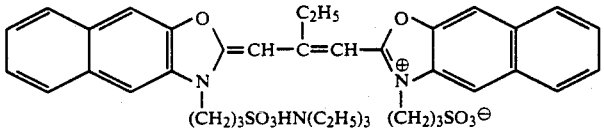
S-7
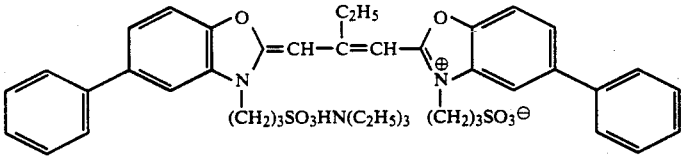
S-8
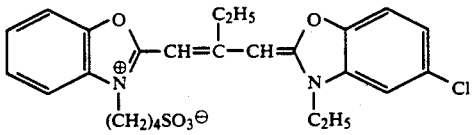
S-9
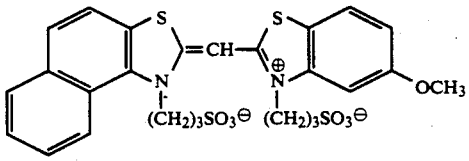
S-10
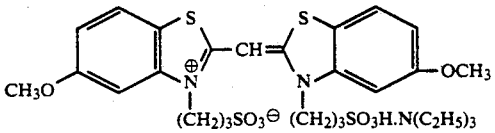

-continued
S-11
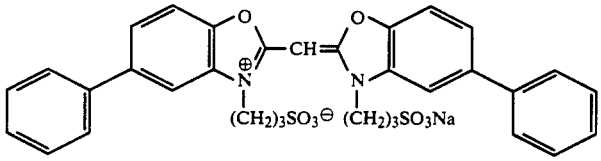
HS-1
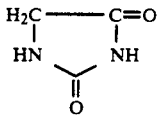
HS-2
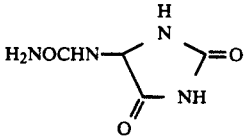
H-1
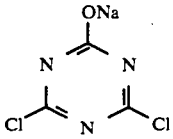
H-2
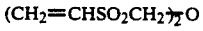
SU-1
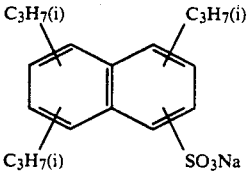
SC-1
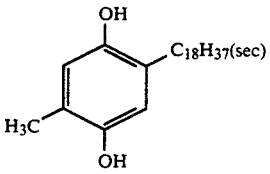
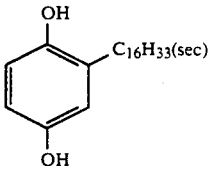
(a 2:3 mixture)
Oil-1
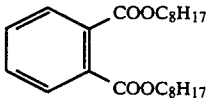
Oil-2
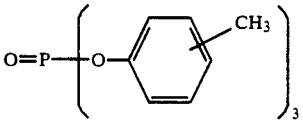
Oil-3
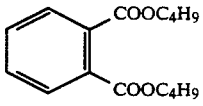
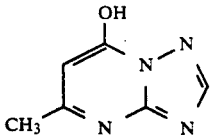
ST-1
AI-1
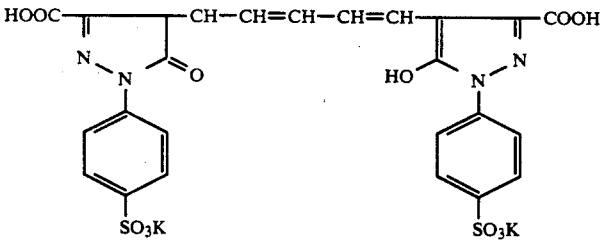
AI-2
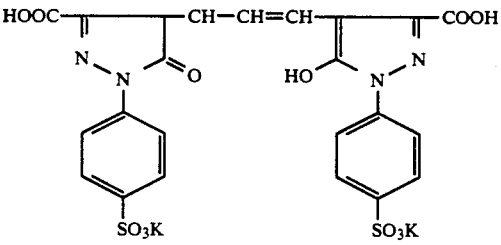
SU-2
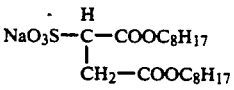

-continued

AF-1

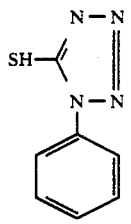

AF-2

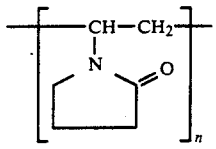

(a mixture of the following three components) DI-1

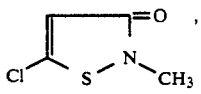

(Component A)

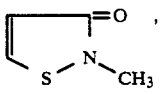

(Component B)

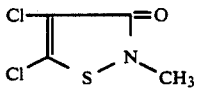

(Component C)

A:B:C = 50:46:4 (molar ratio)

Sample No. 102 to 112 were prepared in substantially the same manner as that employed in the preparation of Sample No. 101, except that the type of coupler and the coupler dispersion method were varied to those shown in Table 1, and that the emulsion EM-A was replaced by those shown in Table 1. These samples did not differ in the amounts of coupler, emulsion and gelatin.

TABLE 1

| | Coupler in 6th layer | | Coupler in 7th layer | | |
|---|---|---|---|---|---|
| | Kind | Dispersion method | Kind | Dispersion method | Emulsion in 7th layer |
| 101 (Comparative) | M-1 CM-1 D-3 | (A) | M-1 CM-1 D-3 | (A) | Em-A |
| 102 (Comparative) | M-1 CM-1 D-3 | (A) | M-1 CM-1 D-3 | (A) | Em-B |
| 103 (Comparative) | M-1 CM-1 D-3 | (A) | M-1 CM-1 D-3 | (A) | Em-C |
| 104 (Comparative) | M-1 CM-1 D-3 | (A) | M-1 CM-1 D-3 | (A) | Em-D |
| 105 (Comparative) | M-1 CM-1 D-3 | (B) | M-1 CM-1 D-3 | (B) | Em-A |
| 106 (Comparative) | M-1 CM-1 D-3 | (B) | M-1 CM-1 D-3 | (B) | Em-B |
| 107 (Invention) | M-1 CM-1 D-3 | (B) | M-1 CM-1 D-3 | (B) | Em-C |
| 108 (Invention) | M-1 CM-1 D-3 | (B) | M-1 CM-1 D-3 | (B) | Em-D |
| 109 (Comparative) | M-1 CM-1 D-3 | (C) | M-1 CM-1 D-3 | (C) | Em-A |
| 110 (Invention) | M-1 CM-1 D-3 | (C) | M-1 CM-1 D-3 | (C) | Em-C |

The coupler dispersion methods (A) to (C) were summarized in Table 2.

TABLE 2

| Dispersion method | Solvent | Dispersion medium |
|---|---|---|
| (A) Oil protect dispersion method | Oil-2 in a weight equal to that of coupler and ethylacotate in a weight twice that | 4.0 wt % aqueous gelatin solution in a volume 7.5 times that of coupler solution (containing 2.0 wt % |

TABLE 2-continued

| Dispersion method | Solvent | Dispersion medium |
|---|---|---|
| | of coupler | of SU-2) |
| (B) Method described in European Patent No. 374,837 | n-Propanol in a weight 3.28 times that of coupler | Water in a weight 15 times that of coupler solution (containing 1.0 wt % of SU-2) |
| (C) Method described in European Patent No. 374,837 | n-Propanol in a weight 3.28 times that of coupler and sodium hydroxide in an amount 2 times that of coupler in terms of mol | Water in a volume 15 times that of coupler solution (containing 1.0 wt % of SU-2 and 1.3 wt % of polyvinylporolidon) |

As for the methods of (B) and (C), a large part of n-propanol was removed with a dialyzing membrane after the coupler dispersion was completed.

Evaluation of Sample

Each sample was exposed to light, and processed by the following procedure.

| Processing procedure (38° C.) | |
|---|---|
| Color development | 3 min. 15 sec. |
| Bleaching | 6 min. 30 sec. |
| Rinsing | 3 min. 15 sec. |
| Fixing | 6 min. 30 sec. |
| Rinsing | 3 min. 15 sec. |
| Stabilizing | 1 min. 30 sec. |
| Drying | |

The compositions of processing liquids were as follows:

| (Color developer) | |
|---|---|
| 4-amino-3-methyl-N-ethyl-N-(β-hydroxyethyl) aniline sulfate | 4.75 g |
| Anhydrous sodium sulfite | 4.25 g |
| Hydroxylamine ½ sulfate | 2.0 g |
| Anhydrous potassium carbonate | 37.5 g |
| Sodium bromide | 1.3 g |
| Trisodium nitrilacetate (monohydrate) | 2.5 g |
| Potassium hydroxide | 1.0 g |

Water was added to make the total quantity 1l (pH=10.1)

| (Bleach) | |
|---|---|
| Ferric ammonium ethylenediaminetetraacetate | 100 g |
| Diammonium ethylenediaminetetraacetate | 10 g |
| Ammonium bromide | 150 g |
| Glacial acetic acid | 10 ml |

Water was added to make the total quantity 1l, and pH was adjusted to 6.0 with aqueous ammonia.

| (Fixer) | |
|---|---|
| Ammonium thiosulfate | 175.0 g |
| Anhydrous sodium sulfite | 8.5 g |
| Sodium metasulfite | 2.3 g |

Water was added to make the total quantity 1l, and pH was adjusted to 6.0 with acetic acid.

| (Stabilizer) | |
|---|---|
| Formaline (aqueous 37% solution) | 1.5 ml |
| Koniducks (manufactured by Konica Corp) | 7.5 ml |
| Water was added to make the total quantity 1 l. | |

Each of Sample Nos. 101 to 112 was duplicated to prepare two more identical samples. These three samples were examined for pressure resistance, image sharpness and sweating, respectively.

Evaluation Method

Pressure resistance:

A constant pressure (load: 5.10 g) was applied to an unexposed sample at a speed of 600 m/min using a sapphire needle with a diameter of 0.025 mmϕ (conforming to JIS K6718). Then, the sample was processed by the aforementioned procedure, followed by drying. Then, the transmission density of the pressurized portion was measured. Increase in transmission density was interpreted as occurrence of pressure fog. The lower the transmission density, the higher the pressure resistance. The results are shown in Table 3.

Sharpness:

A sample was exposed to white light through a filter specifically designed for sharpness evaluation. The sample was then processed by the aforementioned procedure, and examined for MTF (Modulation Transfer Function). MTF was measured at a spatial frequency of 20 lines/mm, and expressed as a value relative to that of Sample No. 101 which was taken as 100.

Sweating:

A sample was moisturized to have a relative humidity of 55%, sealed and subjected to heat treatment at 70° C. for 2 days. Then, the sample was processed by the aforementioned procedure. Evaluation was made according to the following criterion.

c: When the sample was held to light, turbidity was observed.

b: When the sample was held to light, slight turbidity was observed.

a: No sweating was observed in both the surface and the interior of the sample.

The results were summarized in Table 3.

TABLE 3

| | Sharpness | Sweating | Pressure resistance |
|---|---|---|---|
| 101 (Comparative) | 100 | b | 0.13 |
| 102 (Comparative) | 96 | b | 0.17 |
| 103 (Comparative) | 103 | b | 0.13 |
| 104 (Comparative) | 99 | b | 0.16 |
| 105 (Comparative) | 118 | a | 0.25 |
| 106 (Comparative) | 112 | a | 0.27 |
| 107 (Invention) | 123 | a | 0.12 |
| 108 (Invention) | 121 | a | 0.16 |
| 109 (Comparative) | 120 | a | 0.25 |
| 110 (Invention) | 126 | a | 0.11 |

As is evident from Table 3, the samples of the invention were remarkably improved in sharpness and pressure resistance, and almost free from sweating.

EXAMPLE 2

Sample Nos. 111 to 119 were respectively prepared by substantially the same methods as those employed for the preparation of Sample Nos. 101 to 110, except that the emulsions in the 7th layers were varied to those shown in Table 4. The samples were processed and examined by the same methods as those employed in Example 1. The results obtained are shown in Table 5.

TABLE 4

| | Coupler in 6th layer | | Coupler in 7th layer | | |
|---|---|---|---|---|---|
| | Kind | Dispersion method | Kind | Dispersion method | Emulsion in 7th layer |
| 111 (Comparative) | M-1 CM-1 D-3 | (A) | M-1 CM-1 D-3 | (A) | Em-1 |
| 112 (Comparative) | M-1 CM-1 D-3 | (A) | M-1 CM-1 D-3 | (A) | Em-2 |
| 113 (Comparative) | M-1 CM-1 D-3 | (A) | M-1 CM-1 D-3 | (A) | Em-3 |
| 114 (Comparative) | M-1 CM-1 D-3 | (B) | M-1 CM-1 D-3 | (B) | Em-1 |
| 115 (Invention) | M-1 CM-1 D-3 | (B) | M-1 CM-1 D-3 | (B) | Em-2 |
| 116 (Invention) | M-1 CM-1 D-3 | (B) | M-1 CM-1 D-3 | (B) | Em-3 |
| 117 (Comparative) | M-1 CM-1 D-3 | (C) | M-1 CM-1 D-3 | (C) | Em-1 |
| 118 (Invention) | M-1 CM-1 D-3 | (C) | M-1 CM-1 D-3 | (C) | Em-2 |
| 119 (Invention) | M-1 CM-1 D-3 | (C) | M-1 CM-1 D-3 | (C) | Em-3 |

TABLE 5

| | Sharpness | Sweating | Pressure resistance |
|---|---|---|---|
| 111 (Comparative) | 100 | c | 0.10 |
| 112 (Comparative) | 102 | c | 0.11 |
| 113 (Comparative) | 101 | c | 0.11 |
| 114 (Comparative) | 113 | a | 0.21 |
| 115 (Invention) | 121 | a | 0.12 |
| 116 (Invention) | 120 | a | 0.13 |
| 117 (Comparative) | 113 | a | 0.22 |
| 118 (Invention) | 123 | a | 0.11 |
| 119 (Invention) | 121 | a | 0.12 |

As is evident from Table 5, the samples of the invention were remarkably improved in sharpness and pressure resistance and free from sweating.

EXAMPLE 3

Each of Sample Nos. 101 to 119 was subjected to the following continuous treatment, and then examined in the same manner as that employed in Example 1. Treatment was continued until the amount of replenisher became 3-fold the capacity of a stabilizer tank.

| Procedure | Duration | Temperature | Replenishment rate |
|---|---|---|---|
| Color development | 3 min. 15 sec | 38° C. | 540 ml |
| Bleaching | 45 sec | 38° C. | 155 ml |
| Fixing | 1 min. 45 sec | 38° C. | 500 ml |
| Stabilizing | 90 sec | 38° C. | — |
| Drying | 1 min | 40 to 70° C. | — |

(Amount per square meter of light-sensitive material)

Stabilizing was conducted by a counter-current system using three stabilizing tanks. In this system, a replenisher was supplied to the final stabilizer tank, and an overflow was allowed to get into a stabilizer tank in front of the final tank.

Part(275 ml/m$^2$) of an overflow from a stabilizer tank placed behind the fixer tank was allowed to flow into the fixer tank.

| (Color developer) | |
|---|---|
| Potassium carbonate | 30 g |
| Sodium bicarbonate | 2.7 g |
| Potassium sulfite | 2.8 g |
| Sodium bromide | 1.3 g |
| Hydroxylamine sulfate | 3.2 g |
| Sodium chloride | 0.6 g |
| 4-Amino-3-methyl-N-ethyl-N-(β-hydroxyethyl) aniline sulfate | 4.6 g |
| Diethylenetriamine pentaacetic acid | 3.0 g |
| Potassium hydroxide | 1.3 g |

Water was added to make the total quantity 1l, and pH was adjusted with 20% sulfuric acid.

| (Color developer replenisher) | |
|---|---|
| Potassium carbonate | 40 g |
| Sodium bicarbonate | 3 g |
| Potassium sulfite | 7 g |
| Sodium bromide | 0.5 g |
| Hydroxylamine sulfate | 3.2 g |
| 4-Amino-3-methyl-N-ethyl-N-(β-hydroxyethyl) aniline sulfate | 6.0 g |
| Diethylenetriamine pentaacetic acid | 3.0 g |
| Potassium hydroxide | 2 g |

Water was added to make the total quantity 1l, and pH was adjusted to 10.12 with potassium hydroxide of 20% sulfuric acid.

| (Bleach) | |
|---|---|
| Ferric diammonium 1,3-diaminopropane tetraacetic acid | 0.35 mol |
| Disodium ethylenediaminetetraacetate | 2 g |
| Ammonium bromide | 150 g |
| Glacial acetic acid | 40 ml |
| Ammonium nitrate | 40 g |

Water was added to make the total quantity 1l, and pH was adjusted to 4.5 with aqueous ammonia or glacial acetic acid.

| (Bleach replenisher) | |
|---|---|
| Ferric diammonium 1,3-diaminopropane tetraacetic acid | 0.40 mol |
| Disodium ethylenediaminetetraacetate | 2 g |
| Ammonium bromide | 170 g |
| Ammonium nitrate | 50 g |
| Glacial acetic acid | 61 ml |

Water was added to make the total quantity 1l, and pH was adjusted to 3.5 with aqueous ammonia or glacial acetic acid. The pH of the bleacher was kept at this value by a suitable means.

| (Fixer and fixer replenisher) | |
|---|---|
| Ammonium thiosulfate | 100 g |
| Ammonium thiocyanate | 150 g |
| Anhydrous sodium metasulfite | 20 g |
| Disodium ethylenediaminetetraacetate | 1.0 g |

Water was added to make the total quantity 700 ml, and pH was adjusted to 6.5 with glacial acetic acid and aqueous ammonia.

| (Stabilizer and stabilizer replenisher) | |
|---|---|
| 1,2-benziothiazoline-3-one | 0.1 g |
| 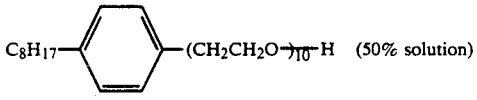 (50% solution) | 2.0 ml |
| Hexamethylene tetramine | 0.2 g |
| Hexahydro-1,3,5-trifluoro(2-hydroxyethyl)-5-triazine | 0.3 g |

Water was added to make the total quantity 1l, and pH was adjusted to 7.0 with 50% potassium hydroxide.

EXAMPLE 4

A sample was prepared in substantially the same manner as that employed in the preparation of Sample No. 110, except that the coupler dispersion method was varied to the following method D. The sample was processed and examined by the same methods as those employed in Example 1, and found to be remarkably improved in image sharpness and pressure resistance and free from sweating.

Dispersion Method D

Using Dainoh mill (a sand mill manufactured by Shinmaru Enterprise), the following coupler composition was subjected to grinding. The griding medium employed consisted of glass beads (MK-5GX, manufactured by Bright Labelling Co., Ltd.) with a grain size distribution degree of not more than 20%.

| Coupler composition | |
|---|---|
| Coupler | 150 g |
| 1% aqueous poly-N-vinylpyrrolidone solution | 2 l |
| Su-2 (2.5% aqueous solution) | 1 l |

The disc of the mill was rotated at a speed of 3,300 rpm, and the temperature of the dispersion in the vessel was kept at 35° C.

EXAMPLE 5

Sample Nos. 151, 152, 153 and 154 were each prepared in substantially the same manner as that employed in Example 1, except that the dispersion of the couplers in the 3rd and 4th layers was conducted by the method described in European Patent No. 374837, and that the emulsion in the 4th layer was varied to Em-C (Sample No. 151), Em-D (Sample No. 152), Em-2(Sample No. 153) and Em-3 (Sample No. 154). The samples were processed and examined by the same methods as those employed in Example 1, and found to be remarkably improved in sharpness, pressure resistance and free of sweating.

EXAMPLE 6

Samples Nos. 161, 162, 163 and 164 were each prepared in substantially the same manner as that employed in Example 1, except that the dispersion of the couplers in the 9th and 10th layers was conducted by the method described in European Patent No. 374837, and that the emulsion in the 10th layer was varied to Em-C (Sample No. 161), Em-D (Sample No. 162), Em-2(Sample No. 163) and Em-3 (Sample No. 164). The samples were processed and examined by the same methods as those employed in Example 1, and found to be remarkably improved in sharpness, pressure resistance and free of sweating.

Preparation of EM-E, an Emulsion Comprising Hexagonal Tabular Silver Iodobromide Grains Using an emulsion, as a seed emulsion, comprising tabular silver iodobromide grains with an average grain size of 0.70 μm, an average aspect ratio of 3, and an average silver iodide content of 20 mol %, an emulsion comprising hexagonal tabular silver iodobromide grains was prepared by the following method.

A 1.57 mol Ag-equivalent amount of the seed emulsion was added to Solution G-10 in a reactor with stirring, while keeping the temperature, pAg and pH of the solution at 65° C., 9.7 and 6.8, respectively. Prior to the addition of a fine crystal emulsion, 7.26 mol of ammonium acetate was added to the reactor. In a mixer provided outside the reactor, Solutions G-20, H-20 and S-20 were added by the triple-jet method at a prescribed flow rate, whereby fine crystals were prepared continuously. The fine crystal emulsion formed in this mixer were continuously supplied to a storage tank. When a prescribed amount of the fine crystal emulsion was accumulated in the storage tank, the emulsion was then supplied to the reactor at an accelerated flow rate over a period of 84 minutes. During that period, the temperature of the mixer was kept at 30° C. and the revolution speed of the stirring blade was kept at 4,000 rpm. The temperature of the storage tank was maintained at 20° C. The average size of the fine crystals supplied to the reactor was 0.01 μm.

pAg and pH of the grain formation system were controlled by adding an aqueous potassium bromide solution and an aqueous potassium hydroxide solution to the storage tank, thereby controlling pAg and pH of the fine crystal emulsion being supplied to the reactor.

The formed grains were rinsed by the conventional flocculation method. Then, gelatin (average molecular weight: 1,000,000) was added to allow the grains to be dispersed. pH and pAg of the grains were adjusted to 5.8 and 8.06, respectively at 40° C.

The resulting emulsion was a monodispersed emulsion comprising hexagonal tabular silver iodobromide grains with an average grain size of 1.38 μm, a variation coefficient of 12.5% and an average silver iodide content of 8.5 mol %. The so-obtained emulsion was designated as EM-E.

EXAMPLE 7

A silver halide light-sensitive material was formed in substantially the same manner as in Example 1, except that A-22 and A-47 were employed respectively in place of M-1 and CM-1. The light-sensitive material was processed and evaluated by the same methods as in Example 1, and found to be improved in sharpness and pressure resistance, and free from sweating. These examples of the invention led to improved results similar to those achieved in Example 1.

What is claimed is:

1. A silver halide color photographic light sensitive material comprising a support having provided thereon a coupler-containing layer, and another layer, wherein said coupler-containing layer contains a high boiling solvent in an amount of 1.0 wt % or less, relative to the weight of the coupler container therein and, said coupler-containing layer or said another layer comprise a silver halide emulsion containing silver halide grains (1) formed by a process comprising;

(I) forming silver halide fine grains (2) by mixing a silver salt and a halide solution in a mixer; and (II) supplying said silver halide fine grains (2) into a reactor to form said silver halide grains (1).

2. A photographic material of claim 1, wherein said coupler-containing layer contains a coupler having a molecular weight of not more than 2000.

3. A photographic material of claim 1, wherein said silver halide grains (1) each have a core/shell-layered structure comprising two or more layers having different silver iodide contents, said grains (1) comprising a high silver iodide content layer having a silver iodide content of 15 to 45 mol % i the central portion thereof.

4. A photographic material of claim 3, wherein said silver halide grains (1) comprise silver iodobromide having an average silver iodide content of 4 to 20 mol %.

5. A photographic material of claim 1, wherein said silver halide grains (1) contain two or more kinds of halogens; said grains (1) being formed by supplying two or more kinds of silver halide fine grains (2) having different halide compositions, wherein at least one kind of said fine grains (2) is comprised substantially of a silver halide containing a single kind of halogen.

6. A photographic material of claim 1, wherein said silver halide grains (1) are formed by a process comprising (i) forming silver halide fine grains (2) by mixing a silver salt solution and a halide solution in a mixer;

(ii) supplying said fine grains into a storage vessel; and (iii) supplying, after said fine grains have been held in the storage vessel for a while, said fine grains into a reactor to form said silver halide grains (1).

* * * * *